US006061840A

United States Patent [19]

Alligator

[11] Patent Number: 6,061,840

[45] Date of Patent: May 16, 2000

[54] MEN'S ANATOMIC UNDERWEAR/ SWIMWEAR

[76] Inventor: Squire Alligator, P. O. Box 170623, San Francisco, Calif. 94117

[21] Appl. No.: 09/262,711

[22] Filed: Mar. 4, 1999

Related U.S. Application Data

[63] Continuation-in-part of application No. 09/023,508, Feb. 13, 1998, abandoned.

[60] Provisional application No. 60/090,436, Jun. 24, 1998.

[51] Int. Cl.[7] ..... A41B 9/00

[52] U.S. Cl. ..... 2/403; 2/400

[58] Field of Search ..... 2/400–405; 604/67–72

[56] References Cited

U.S. PATENT DOCUMENTS

| | | | |
|---|---|---|---|
| 1,477,187 | 12/1923 | Rayne | 602/71 |
| 3,037,503 | 6/1962 | Ravaschieri | 602/69 |
| 3,517,666 | 6/1970 | Atlee | 2/403 |
| 4,590,931 | 5/1986 | Kidwell, Jr. | 604/347 |
| 5,036,839 | 8/1991 | Weiss et al. | 602/71 |
| 5,157,793 | 10/1992 | Michels | 2/403 |
| 5,314,447 | 5/1994 | Papurt | 128/842 |

FOREIGN PATENT DOCUMENTS

| | | | |
|---|---|---|---|
| 264690 | 1/1927 | United Kingdom | 602/71 |

*Primary Examiner*—Gloria M. Hale

[57] ABSTRACT

A male brief, specifically underwear, swimwear, sunwear, supporter, medical brief, or enhancement device is designed to be worn instead of men's usual underwear and swimwear. The brief's form follows the anatomical design of the penis and the scrotum, which are two naturally separated, yet integrated entities. Its one-piece, genital specific, dual-pouch construction has an entrance opening with a closure that encircles the base of the genitals. To achieve superior support and comfort the brief is designed to accurately conform to the changing shapes, movements and precise positions that the genitals make of their own accord to maintain comfort and health. This allows the genitals to dictate their own comfort, and at the same time be held by the brief in a protective and supportive way. Because the brief is configured to reflect the exact contours of the genitals, it possesses unadulterated lines that house the genitals with a never-before-achieved attractiveness by allowing their natural carriage and authentic masculine style to be expressed in a way that reflects their own image. A fly system (66) built into pouch (16) allows for the release of the penis for urinating without having to remove the brief. Modifying the crotch portion of conventional underwear and swimwear with the brief provides a customary alternative for the consumer to become familiar with the brief's break-through comfort, and support technology. A non-stretch embodiment gives the consumer an even broader range of fabrics, and styles from which to choose.

14 Claims, 21 Drawing Sheets

MEN'S ANATOMIC UNDERWEAR/ SWIMWEAR

BACKGROUND—CROSS-REFERENCE TO RELATED APPLICATIONS

This application is a continuation-in-part of my U.S. Patent Application Ser. No. 09/023,508 filed Feb. 13, 1998, now abandoned titled Male Wearing Apparel. Additionally, this application claims benefit of my provisional Patent Application Ser. No. 60/090,436, filed Jun. 24, 1998, titled Male Wearing Apparel Anantomic Briefs/Swimwear.

BACKGROUND

1. Field of Invention

This invention relates to male wearing apparel, specifically to wearing apparel for men as either underwear or swimwear.

2. Description of Prior Art

Male underwear, swimwear, sports, or medical protective devices are well known and commonly comprise briefs, boxer shorts, bikini briefs, thongs, various forms of athletic supporters, and cups, and what are referred to in the medical art as bandages. Virtually all styles of briefs, supporters, underwear, and swimwear garments share the common characteristic of a single-pouch construction for holding the two principal parts of the male genitalia. This single-pouch construction compacts the male genitalia together, causing crowding, sticking, bunching, misalignments, entanglements, itching, abrasion, the pulling of hair, cramping, compressing to an unnatural limpness (caused by preventing proper blood circulation), and occasionally squeezing to the point of pain.

The single-pouch construction bears no resemblance to the structure of the male anatomy. The penis and the scrotum, although joined, are two separate entities. To squash them together into a single-pouch as if they were one, distorts their natural shape. This leads to crude and abusive results in an unsuccessful attempt to comfortably cover and support the male genitalia. In the case of boxer shorts, everything is allowed to hang dangerously in harm's way, unprotected and unsupported, leaving protection up to chance and often causing abrasive friction.

No prior-art underwear, whether conventional or alternative, is designed to house the genitalia with a cover which accommodates the shapes, or the ever-changing contours, sizes, and positions of the genitals.

Many urologists and fertility specialists believe that briefs constrict the scrotum. The compacting and compressing nature of the single-pouch design does not allow the scrotum to regulate its temperature by contracting and expanding, thus it restricts proper blood flow to the testes. The result of such constriction is the killing of millions of sperm cells, which leads to male infertility. Boxers do not interfere in such a manner. However, boxers provide no protection or support at all. This can, and does lead to adverse results as well.

Many prior-art designs for covering the male genitalia are extremely complex. Some are difficult to don; others are painful to wear, and others are bizarre in appearance. None seem to accommodate the architectural shape of the male genitalia. All of them try to recreate the lines, and contours of the genitals with their own particular design. All prior-art designs disturb and distort the shape of the genitalia.

In general, male apparel of the underwear, swimwear, supportive and protective types fall into four categories . . .

PRIOR ART

First Category

The first category includes all forms of conventional, traditional, and trendy underwear, whether they are briefs, bikinis, designer briefs, boxers, fitted boxers, athletic supporters, thongs, and all styles of swimwear. Their primary design characteristic is that they all have a front panel which either covers, and/or, provides a small amount of material to act as a single-pouch support for holding the genitals. These front genital covers are integrated into the underwear, and held to the body by including a waistband. Usually, but not necessarily, the designs of this category include a covering for the buttocks. These underwear garments are nothing more than trousers made small, or "brief", as the nomenclature implies. Alternatively, the rear portion can employ straps that extend from the perineum to the back-center or to the back-sides of the waistband.

Examples of the first category can be found in the U.S. Pat. No. 1,119,944 to Fritsch (1914), U.S. Pat. No. 3,504,671 to Nelkin (1970), U.S. pat. No. 3,517,666 to Atlee (1970), Des. 304,775 to Eckrode (1989), U.S. pat. No. 5,094,234 to Searcy (1992), U.S. Pat. No. 5,157,793 to Michels (1992), and U.S. pat. No. 5,243,974 to Allen (1993). Almost all underwear and swimwear found throughout the marketplace and in catalogs fall into this first category. The most common differences in these designs are various waistband widths, how large the brand names are imprinted on their waistbands, and whether or not they have extended material around the back to cover the behind. Generally, all of these underwear garments cause varying degrees of discomfort, and are all imitations of each other and of the same traditional style.

These underwear designs are more derived from baby diapers than from a design meant to fit the male genitalia. The physiological reality is that grown men are fully developed, and need an underwear configured to fit that development. Thus, these diaper-based underwear garments do not accommodate the genital development past the age of puberty. The designs in this category are impostors and pretenders, only posing to comfortably support and protect the adult male.

For example, Michels takes a French Cut brief, cuts an oval-shaped hole in the crotch panel, attaches a dome-shaped single-pouch to it, and calls it "ergonomic". Ergonomics is a discipline for making technological design adapt to the shape and function of the human body. Not only is Michels' underwear not ergonomic, it's single-pouch violates the ergonomic precept.

Second Category

The second category is nearly a sub-category of the first category, they all possess; an integrated waistband, some have a buttocks cover, and some have underneath perineum straps connecting the front to the back. The design element that distinguishes this category from the first is variations in the front genital panel. Each of these underwear garments creates front panel mechanisms which attempt to separate the penis from the scrotum.

Examples of the second category are shown in U.K. Patent 264,690 to Sarasow (1927), and U.S. Pat. No. 860,584 to Teufel (1907), U.S. Pat. No. 1,477,187 to Rayne (1923), U.S. Pat. No. 2,700,971 to Mestel (1955), U.S. Pat. No. 4,195,630 to Connery (1980), Des. 268,964 to Riedell (1983), U.S. Pat. No. 4,526,167 to Ebenal (1985), U.S. Pat. No. 4,702,239 to Ichikawa (1987), U.S. Pat. No. 5,070,869 to Zhang (1991), U.S. Pat. No. 5,237,706 to Nalbandian (1993), U.S. Pat. No. 5,275,592 to Grizzaffi (1994), and U.S. Pat. Nos. 5,283,912 and 5,429,622 to Chung (1994 and 1995). Most of these contraptions are designed for surgical, or medical applications, and are not intended to provide comfort or support. These designs use either straps, flaps, channels, loops, yokes, bags, pockets, holes, or slots for wrangling, hanging, suspending, or entering the penis into, or containing the scrotum. These mechanisms create an unnatural and often times painful separation of the penis from the scrotum.

Riedell's underwear recreates the shapes of the penis and the scrotum with a cosmetic look. This underwear has a square-ended penis sack, and a scrotum sack that is on the same plain as the penis and behind it. Wearing this genital-violating container would be extremely painful. Riedell's underwear is for when one wishes to express the appearance of deformed genitals.

Third Category

The third category includes protective devices structured to cover only the male genitalia. These devices are held in place by wearing conventional briefs or athletic supporters over them; that is, they have no integral retaining means. Representative designs in this category are the U.S. Pat. No. 3,229,692 to Creed (1966), U.S. Pat. No. 3,314,422, to Phillips (1967), Des. 294,075 to Bernstein (1988), and U.S. Pat. No. 4,731,063 to Newkirk (1988).

The items in this category are cumbersome in that they are retained by an extra piece of clothing. Additionally, none of these designs covers the genitalia according to their own shape. Rather, all of these designs provide an unrelated shape that is imposed upon the genitalia. All of these designs would be, at the very least, uncomfortable. In the case of Phillips—a very pretty looking sea shell mold for swimwear—because of its scalloped curve at the perineum, it would be very painful to wear.

Fourth Category

Also in the prior-art is a fourth category of decorative and protective devices which are designed to cover only the crotch area of the wearer, whether it is the scrotum or the penis or both for men, or the vaginal and pubic areas for women. These devices are held in place by means which either bind around the base circumference of the male genitalia, or use a wire retainer which extends from the front crotch area to the rear between the buttocks. Representative designs in this category are U.S. Pat. No. 2,534,934 to Viniegra (1950), U.S. pat. No. 3,339,208 to Marbach (1967), U.S. Pat. No. 4,590,931 to Kidwell, Jr. (1986), U.S. Pat. No. 5,036,839 to Weiss et al. (1991), U.S. Pat. No. 5,314,447 to Papurt (1994), U.S. Pat. Nos. 5,367,715 and 5,396,662 to Leonard et al. (1994 and 1995), and U.S. Pat. No. 5,467,482 to Crawford (1995).

The fabric covered wire devices of Viniegra, Marbach, Weiss, Leonard, and Crawford are functional only for women, whether intended or not. The front cover is a flat fabric suspended by a wire frame with no attempt to shape the fabric to the genitals. There is nothing to hold the genitalia. This wire-covered device is more of a placard or a flat facing, than it is a cover. If a man wears it, it is held away from his body by his genitals. This would be very uncomfortable, and at best, would cause his genitals to be exposed from the top, bottom and sides, but most likely they would fall out the bottom, completely exposing him.

Kidwell shows a scrotum guard. Kidwell's guard bears no resemblance to the shape of the scrotum. The reverse is true, its shape is in conflict with the shape of the scrotum. Kidwell's guard looks like the front end of a canoe. It is a wedge-shaped cone, not round like a funnel, but flat with two side edges, and a wide opening that narrows to a pointed, curved bottom. After disclosing it as a scrotum guard with a retaining strap that wraps around the base of the genitals, Kidwell adds confusion to the meaning of its shape, function, and the way it attaches to the body. He states that the penis could be included in this oddly shaped guard, or that the scrotum could be left out and only the penis could be enclosed, or that the guard could simply enclose the testicles with the closure strap wrapping around the scrotum.

The shape of Kidwell's guard bears no similarity to the shape of any one part of the genitalia nor to the shape of the genitalia as a whole. It's not shaped to house the genitalia one at a time nor all together in one. Because of its genital opposing shape, it could not successfully seal off the unwanted solutions, liquids, and fecal matter it is designed for, and it could never be classified as a cover for the genitals; something that its shape has absolutely no relationship to.

Papurt discloses a male condom for the purpose of disease prophylaxis and/or contraception. Papurt's condom is shaped for use only during periods of sexual activity and is implemented only when this sexual activity is with another person, or persons.

If mistaken for a genital cover, Papurt's design is anatomically incorrect. Papurt's penis enclosure is not a penis cover; its extreme length is designed to fit the shape of erections, only erections. Papurt's erection tube has additional appendages; an enclosed reservoir at the tip of the erection tube for receiving and containing ejaculate, and an elastic latex ring bonded into the erection tube. To use this condom as a genital cover, with an elastic ring contracted around the penis shaft would restrict blood flow to the penis, cause irritation, discomfort and pain, and bruise the penis shaft, .

The shape of the scrotum part of Papurt's condom is miniature in size and attempts to fit only sexually aroused, contracted scrotums. Furthermore, its shape is defective in that it swings forward. In normal physiology the scrotum curves rearward. Moreover, on the lateral sides of the condom's entrance there are two integrated handles for pulling it on. These handles would compress and compact between the inner thighs and the genitals, plus pubic and leg hair would entangle in them, as well as entangle in an additional latex ring located at the base of the condom. This handle compacting and hair tangling would cause discomfort and pain for the wearer.

To serve the purpose of its shape, Papurt's condom is donned immediately before genital contact and removed immediately after sexual engagement. To complete its purpose, the user immediately throws it away upon removal so that the sex partners do not encounter the potentially hazardous residue that clings to its exterior, nor be exposed to the potentially hazardous or unwanted contents found inside its interior. It cannot and must not remain on the wearer as a genital covering or clothing.

This condom is not shaped for covering the genitals in their normal state, nor for adapting to the changing sizes and positions that the genitalia make continually throughout the day. Papurt's condom shape is stuck in the single genital position of sexual arousal. If a person wanted to misuse this condom as a genital cover, the user's genitalia would have to be stuck in a permanent state of sexual erection. Papurt's condom shape is clearly non-conforming, and appendage burdened. The fourth embodiment shows the condom cut in half; separating the scrotum part from the erection part. Even as a condom shaped for sexual engagement, he was forced to make it a two-piece device. Nothing about this condom indicates an integrated cover for the genitals.

In summary, all prior-art men's underwear has a general problem. It does not conform to anatomic structure, and attempts to hide or reshape it. This practice of hiding and reshaping results in discomfort and poor support. There are surely many reasons for this, including; the ignorant adherence to tradition, compliance to the marketplace, competitive imitation of products, cultural apprehension about the male anatomy, and cosmetic redesigning.

OBJECTS AND ADVANTAGES

Accordingly, besides getting an underwear/swimwear garment which is designed by using correct male genital information, several objects and advantages of the present invention are:

(a) to provide an improved underwear garment for men;

(b) to provide men's underwear and swimwear which follows the natural genital separation with a correctly shaped garment that accommodates, protects, and supports the ever-changing shapes and sizes of the genitals;

(c) to provide men's underwear and swimwear that maintains its genital specific characteristics by employing an entrance closure that wraps around the periphery of the genitals, and thereby extends no further than their base;

(d) to provide men's underwear and swimwear that follows the natural genital configuration and creates no unusual shapes, no oddly distorted contours, no add-on features, presents no deformities, or unnatural demands upon the genitalia, and thereby supports and protects in a way that leaves the classic masculine style intact;

(e) to provide the wearer with a never-before-experienced freedom;

(f) to provide men's underwear and swimwear with comfort and support that has never before been achieved, by eliminating the anatomic incorrect, conventional single-pouch construction discomforts that compact the genitals together, causing crowding, sticking, squeezing, bunching, misalignments, entanglements, itching, abrasion, pulling hairs, compacting, cramping, compressing and pain; and (g) to provide a design similar to conventional underwear and swimwear, but with a modified front.

Further objects and advantages of my underwear and swimwear are to provide protection for the circumcised penis, to protect sperm vitality by not compacting and restricting blood flow to the scrotum, to provide the wearer with the opportunity to augment the size of his penis, to provide an easy to don garment in that the wearer does not have to step through leg holes and pull up an awkward waistband, and to provide an inexpensive brief. Still further objects and advantages will become apparent from the consideration of the ensuing description and drawings.

BRIEF DESCRIPTION OF THE DRAWINGS

In the drawings, closely related figures have the same number but different alphabetical suffixes.

Figure 1A:
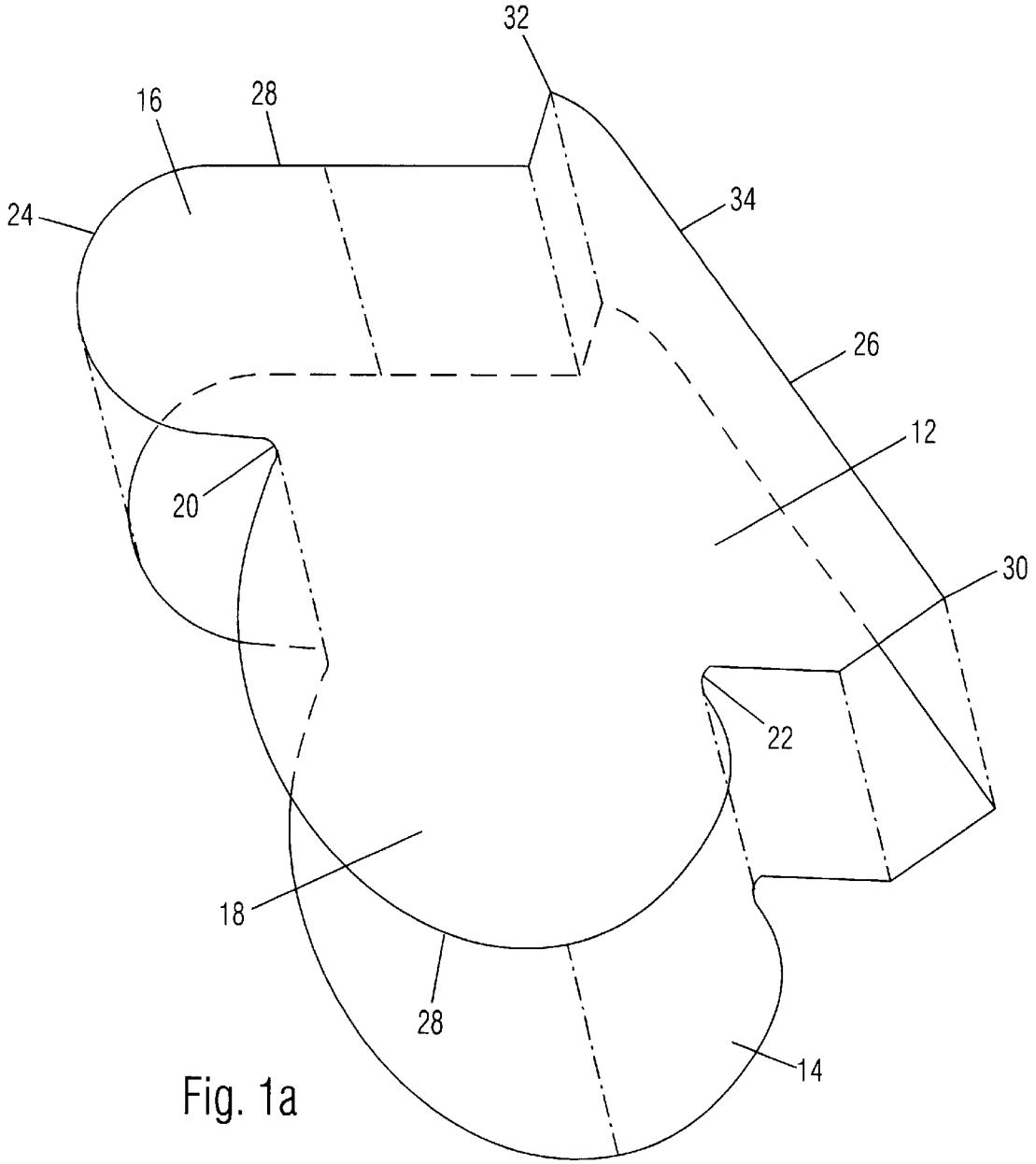
FIG. 1*a* shows an assembly perspective view of two fabric pieces of a preferred embodiment of my underwear/swimwear.

| Reference Numerals in Drawings |
|---|
| 12. assembly fabric piece |
| 14. assembly fabric piece |
| 16. penile pouch |
| 18. scrotum pouch |
| 20. outer indentation |

-continued

| Reference Numerals in Drawings |
|---|
| 22. inner indentation |
| 24. distal end |
| 25. invisible collar |
| 26. entrance opening |
| 28. assembly stitch |
| 30. assembly stitch beginning |
| 32. assembly stitch end |
| 34. proximal fabric edge |
| 36. entrance hem stitch |
| 38. entrance closure hem |
| 40. entrance edge |
| 42. interior side |
| 44. male genitalia |
| 46. male body |
| 48. penis |
| 50. glans |
| 52. scrotum |
| 54. neck penis skin |
| 56. glans neck |
| 58. entrance top |
| 60. entrance bottom |
| 62. exposed elastic closure |
| 63. trademark or logo |
| 64. one-piece knit construction |
| 66. preferred fly system |
| 67. forefinger |
| 68. preferred fly opening |
| 69. thumb |
| 70. fly tip piece |
| 72. tip piece rear portion |
| 74. tip piece rear edge |
| 76. fly rear piece |
| 78. rear piece forward portion |
| 80. rear piece forward edge |
| 82. distal end opening |
| 84. zipper |
| 86. zipper teeth or channel |
| 88. zipper pull tab |
| 90. zipper hem folds |
| 92. conventional underwear |
| 94. front fabric panel |
| 67. forefinger |
| 68. preferred fly opening |
| 69. thumb |
| 70. fly tip piece |
| 72. tip piece rear portion |
| 74. tip piece rear edge |
| 76. fly rear piece |
| 78. rear piece forward portion |
| 80. rear piece forward edge |
| 82. distal end opening |
| 84. zipper |
| 86. zipper teeth or channel |
| 88. zipper pull tab |
| 90. zipper hem folds |
| 92. conventional underwear |
| 94. front fabric panel |
| 96. rear fabric panel |
| 98. front panel semi-circular edge |
| 100. front semi-circle center point |
| 102. front connecting tab |
| 104. front connecting tab |
| 106. front panel top edge |
| 108. front panel side edge |
| 110. front panel side edge |
| 112. rear panel semi-circular edge |
| 114. rear semi-circular center point |
| 116. rear connecting tab |
| 118. rear connecting tab |
| 120. rear panel top edge |
| 122. rear panel side edge |
| 124. rear panel side edge |
| 126. aperture |
| 128. front aperture stitch line |
| 130. rear aperture stitch line |

-continued

| Reference Numerals in Drawings |
|---|
| 132. waist band |
| 134. non-stretch entrance opening |
| 136. assembly stitch beginning |
| 138. assembly stitch end |
| 140. top closure zipper |
| 142. zipper pull tab |
| 144. closure end point |
| 146. entrance closure hem |
| 148. right hem opening |
| 150. left hem opening |
| 152. entrance closure belt |
| 154. belt buckle |
| 156. fabric channel |
| 158. channel opening |
| 160. channel opening (not shown) |
| 162. drawstring |

SUMMARY OF INVENTION

In accordance with the present invention, male briefs, swimwear, beachwear, sunwear, athletic supporters, medical briefs, and a penile enhancement device comprise a design made to fit the anatomic shapes of the male genitals. This assembly is engineered of a one-piece configuration containing two independent, yet integrated pouches, shaped in the image of the penis and the scrotum, with a unique entrance opening that has its closure at the base of the genitals. This garment is anatomically crafted to conform to the shapes of the penis and the scrotum as they are found in their natural, undisturbed state. This construction holds and houses the two prominent parts of the male genitalia, i.e., the penis and the scrotum in a configuration that provides the comfort that is inherent in their own carriage. This design possesses clean, simple lines that do not distort, misshape, deform, interfere with, or otherwise add to or take away from the male anatomy. Rather, this garment supports, and protects in a way which allows the male anatomy to experience the comfort of its natural feel, and express the figure of its natural style. When assembled, this garment accurately accommodates the changing sizes and shapes of the penis and the scrotum, no matter the activity in which the wearer is engaged, without constricting, compacting together, restricting, or limiting the precise movements that the genitals make of their own accord to maintain comfort and health.

Figure 1B:
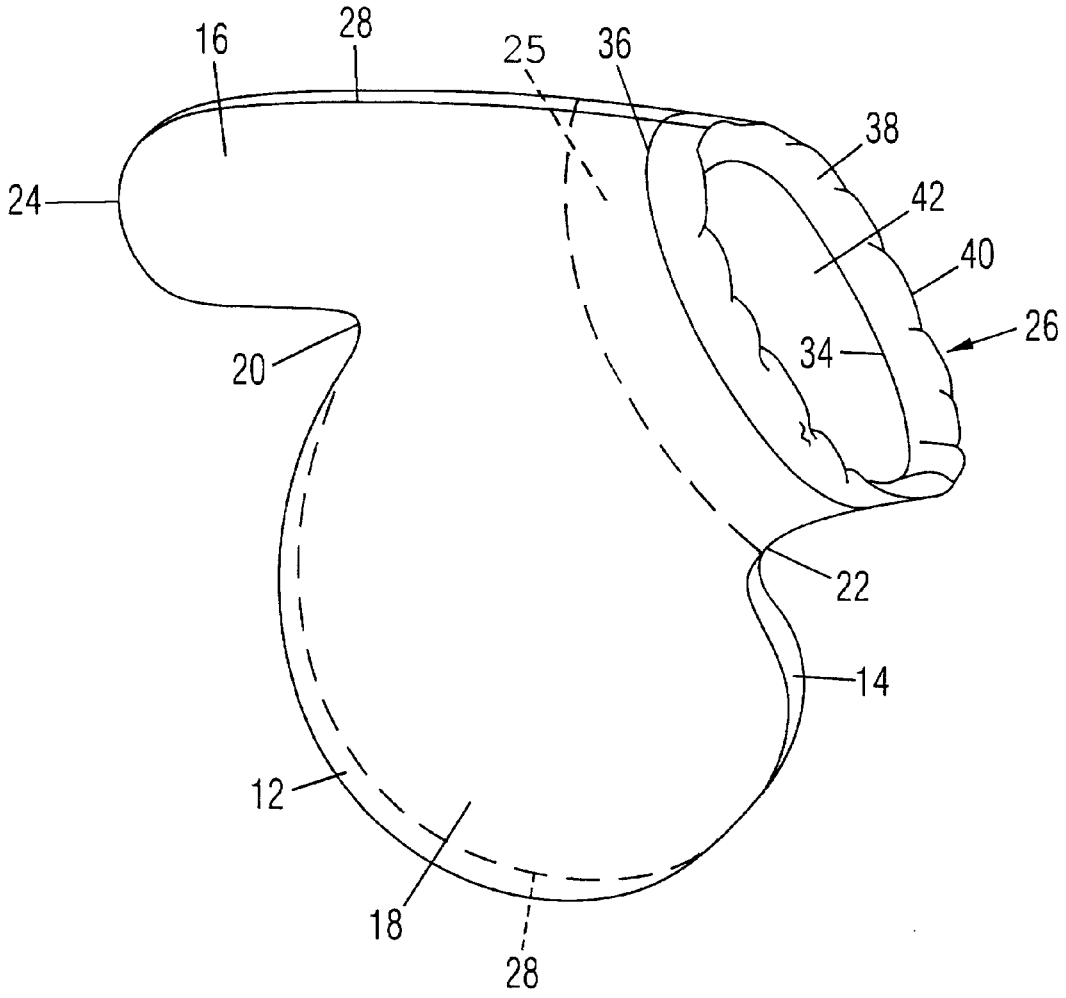
FIG. 1*b* shows an assembled perspective view, indicating the essential elements and contours of a preferred embodiment of my underwear/swimwear as with FIG. 1*a*.

Description—FIGS. 1*a* and 1*b*—Essential Elements and Contours

FIGS. 1*a* and 1*b* show a male brief (undergarment or bathing suit) according to a basic embodiment of the invention.

The brief is preferably constructed of two identically cut fabric pieces. The first fabric piece is an assembly fabric piece 12 and the second is an assembly fabric piece 14 that are cut generally to the shape shown in FIG. 1*a*. Male genitals have two main structural features, the penis and the scrotum, each of which has a separate and distinctly different shape from one another. The perimeters of pieces 12 and 14 reflect the basic shapes of the male genitalia. The shape of the brief includes two contoured forms or pouches, pockets, sleeves, sacks, bags, containers, coverings, chambers, or tubes configured in conformity with the penis and the scrotum. For the purpose of continuity in description, these two contoured forms will be referred to as a penile pouch 16 and a scrotum pouch 18. The perimeters of pieces 12 and 14 have four principal features that constitute the genital conforming characteristics of the brief. These features are two indentations, an outer indentation 20 and an inner indentation 22, an outer enclosed end or a distal end 24, and an inner or proximal open end or an entrance opening 26. When pieces 12 and 14 are sewn together the principal features of the brief form the one-piece genital specific garment containing pouches 16 and 18 and their common entrance 26.

The size and dimensions of fabric pieces 12 and 14 varies depending upon the grade (grade is the term used for size in clothing nomenclature) being constructed. The length of penile pouch 16 of pieces 12 and 14 can vary greatly. Measuring from entrance opening 26, through the center of pouch 16, to the tip of distal end 24, the length can range from 5 mm to 20 mm, stretching to as much as 30 mm. If the penis being fitted requires it, or if an augmented look is desired, it can be made even longer. The width of pieces 12 and 14 at pouch 16 varies between 3 mm and 9 mm, making the circumference of pouch 16 range between 6 mm and 18 mm. Again, this measurement depends upon the penis being fit or the augmented look the wearer is attempting to achieve. Scrotum pouch 18 of pieces 12 and 14 form an irregular circumference. Measuring from a center point which lies half way between indentations 20 and 22, the radius ranges from 3 mm to 10 mm, depending on the point of the circumference being measured, the scrotum being fit, and the possible augmented look a wearer is trying to achieve. The width of pieces 12 and 14 at entrance 26 varies from 6 mm to 14 mm, making the circumference range from 12 mm to 28 mm.

To assemble and create the conforming shape of the brief, fabric pieces 12 and 14 are placed face-to-face, inside-out and sewn together along their matching and aligned perimeters with an assembly stitch line 28 shown in FIGS. 1*a* and 1*b*. Pieces 12 and 14 are stitched continuously from an assembly stitch beginning 30 to an assembly stitch end 32 or in reverse, from stitch end 32 to stitch beginning 30, leaving a rearward, or a proximal fabric edge 34 unstitched.

Entrance opening 26 (FIGS. 1*a* and 1*b*) is completed by folding over fabric edge 34 and sewing an entrance hem stitch 36 (FIG. 1*b*) to make an closure hem 38 and an entrance edge 40. The measurements of closure hem 38 vary between 0.3 mm to 3 mm in width. An elastic strip, stitched together at both ends to form a loop (not shown) is enclosed within closure 38, which retains the brief on the wearer. The length of the elastic strip, before it is stitched into a loop (not shown), measures between 10 mm to 20 mm in length, depending upon the circumference of the pubic base being fit. The reason for the retaining elastic is to secure the brief on the wearer. The elastic should not be too tight on the user. It should simply encircle the genitals with a snug fit. In this way closure stays on the wearer without interfering with the blood flow to the genitals, and does not irritate the tender tissue of the perineum. Other retaining means may be used, e.g., drawstrings, belts, chains, pull tabs, etc. (not shown). When turned right side out, stitches 28 and fabric edge 34 will be on an interior side 42 (FIG. 1*b*) of the brief.

Figure 2:
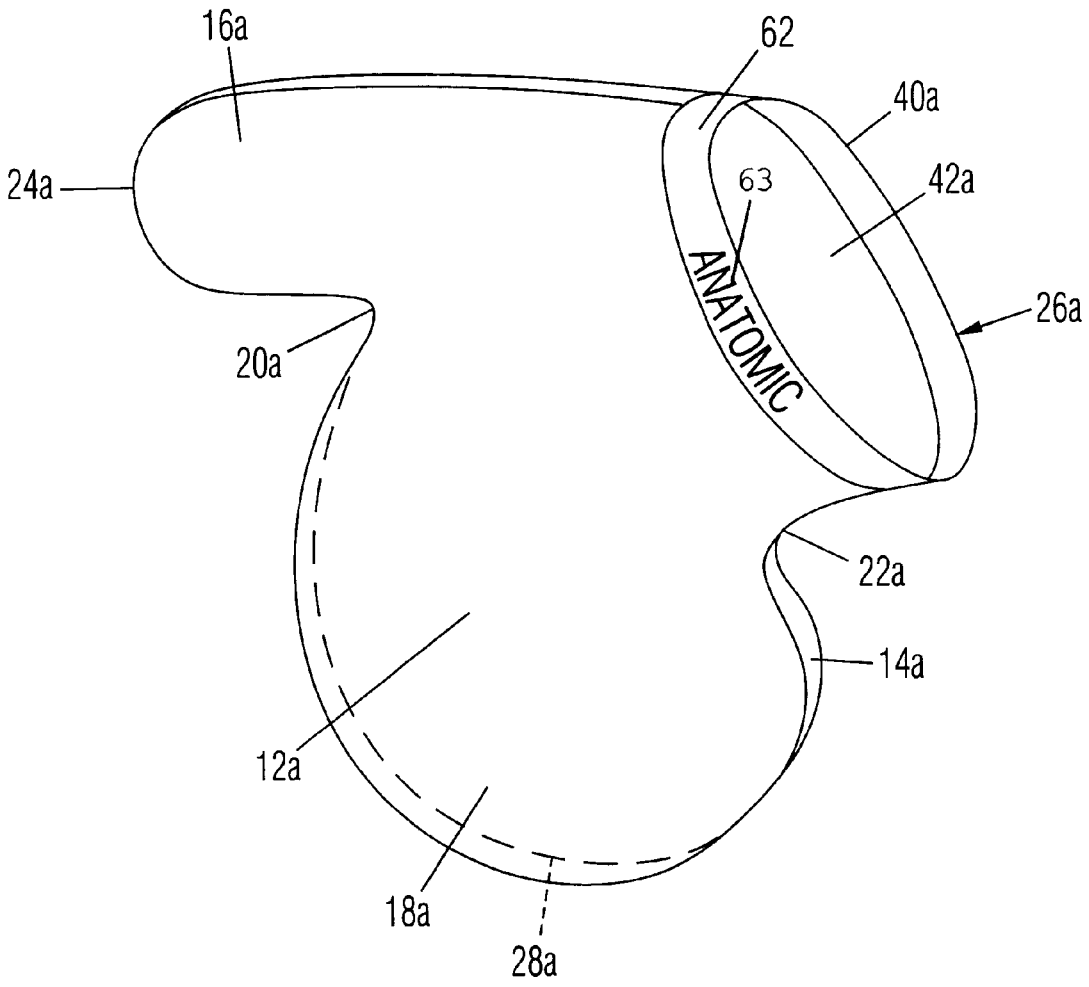
FIG. 2 shows a perspective view of an exposed elastic closure, second embodiment of my underwear/swimwear.
Figure 3:
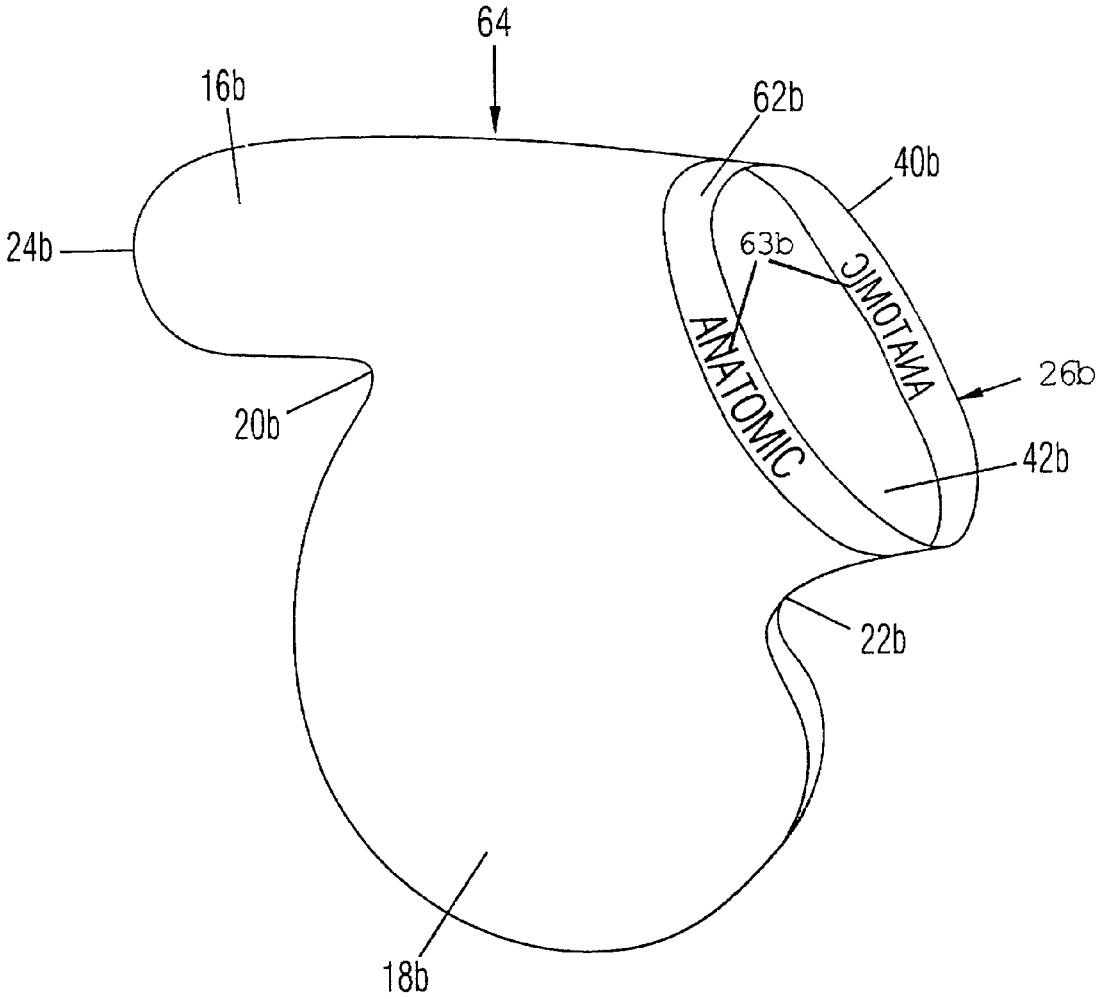
FIG. 3 shows a perspective view of a one-piece knitted, third embodiment of my underwear/swimwear.

Referring to FIG. 1*b* there is a peripheral collar around the brief, forward of (in a distal direction) entrance hem stitch 36 that forms an undemarcated portion or an invisible collar 25. Collar 25 can also be referred to as a band, a ribbon, a strip, a girdle, and a belt. For the purpose of continuity it will be referred to as a collar. It is referred to as an invisible collar because it is not a separately attached fabric piece. Collar 25 is part of fabric pieces 12 and 14, and is formed as an extension portion to integrate penile pouch 16 and scrotum pouch 18 to the periphery of the base of the genitals and to entrance 26. Collar 25 is the juxtaposing area forward of closure hem 38 that encircles the brief at a width of 2 mm to 5 mm (depending on the brief size). In FIGS. 2 and 3 it is the same area and lies forward, juxtaposed to exposed elastic closure 62 and 62*h*, respectively. The measurements and dimensions of collar 25 are totally dependent upon and determined by the sizes of pouches 16 and 18, and entrance 26.

Although not indicated by a dashed line and a reference numeral in any of the following FIGS., as in FIG. 1*b*, invisible collar 25 is an obvious and distinct part of the brief's shape and contour in all of the following embodiments.

Entrance opening 26, penile pouch 16, and scrotum pouch 18 will vary in size, depending upon the grade needed by the wearer. The example used in FIGS. 1*a* and 1*b* represents the proportions of a medium size for pouch 16, pouch 18, and entrance 26. Since all men are different in growth, it is possible, if not probable, to have a combination of sizes in one embodiment, e.g., a small pouch 16, with a large pouch 18, and a medium entrance 26.

The primary fabric used for making prototypes of the brief is stretch knit blended with spandex. Spandex is the generic name for a variety of elastic textile fibers made chiefly of polyurethane. (LYCRA is one trademark for spandex and is owned by E. I. duPont de Nemours & Co., Wilmington, Del.). The spandex content in the fabric of the brief ranges greatly, depending upon the amount of stretch and support needed, or desired. To cover a variety of production models the spandex content can vary from 2% up to 60% and even greater when more stretch is necessary. The most common spandex content range is between 10% and 30%. The fabric should be, but is not limited to being an all-way stretch interlock knit or eight-way stretch interlock knit.

The fabrics preferred at the time of filing this application include blends of spandex with cashmere, cotton, hemp, linen, metallics, nylon, polyester, rayon, silk, terry cloth, velvet, velour, wool, and stretch vinyl. Spandex can be blended with any fabric or fiber and applied to the brief. Any weights of fabric can be used for the brief; light, light/medium, medium, medium/heavy, and heavy. Different weights are preferred for different purposes.

For example, if a wearer wants the brief to expand to accommodate a full erection, expanding from 5 mm flaccid to 11 mm erect, or from 8 mm flaccid to 15 mm erect, or from 13 mm flaccid to 26 mm erect, a light to light/medium weight fabric is preferred with a spandex content from 10 percent up to 30 percent. If a wearer wants a normal, everyday underwear, that nearly allows for a fully expanded erect penis and at the same time completely contains a full erection, a medium weight fabric is preferred with a spandex content from 10 up to 30 percent. If a wearer wants the brief to provide extra support for activities like physical workouts, labor, or athletic play, then a medium/heavy or heavy weight fabric is preferred, with a spandex content up to 30 percent. All of these fabrics and blends provide excellent comfort and support.

It is the all-way stretch characteristics of this blended spandex and knit fabric, in tandem with the genital specific design, that gives the brief its ability to conform to the continually changing contours and shapes of the male genitalia. The brief conforms to and contains the male genitals in a comfortable, non-constricting, non-restricting, supportive, and stylish way. The scrotum is allowed to expand and contract, regulating its temperature for sperm vitality, and the brief completely accommodates the penis for its flaccid and erect states.

Obviously, a complete array of colors and prints are suitable for both the underwear and swimwear models of the brief. This will include newly created print designs based upon the contours and highlights of the body and the shapes, lines, and sportiness of the conforming brief. Also a Trademark and logo can be applied anywhere on the fabric of the main body of the brief, such as pouches 16 and 18, and on the closure band of the brief.

Figure 8:
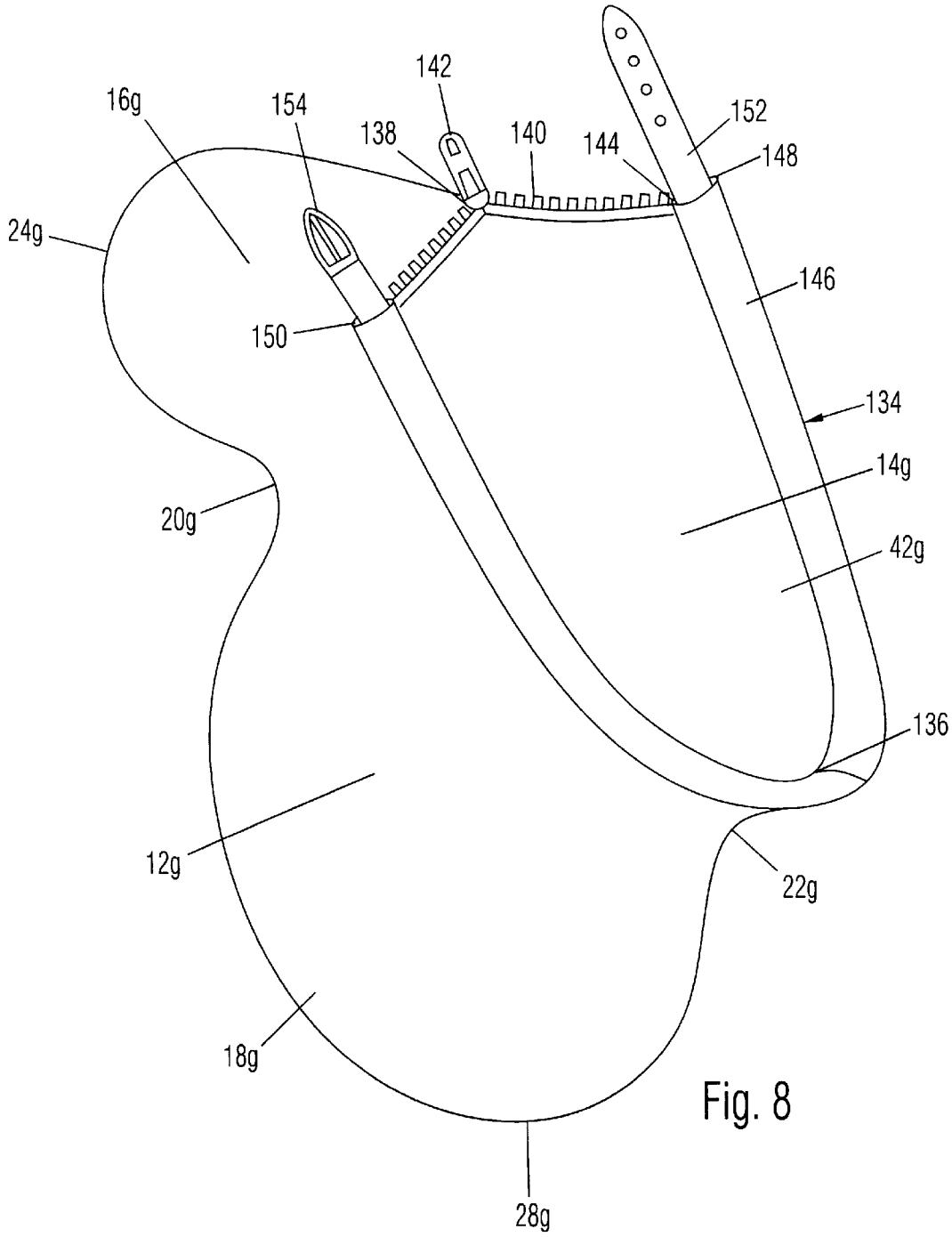
FIG. 8 shows a perspective view of my underwear/swimwear in a non-stretch, eighth embodiment.

The fabric make-up of the brief is not limited to using knit, spandex, or any other polyurethane fiber. The brief is designed for use with all stretch fabrics and as shown in FIG. 8 below, all non-stretch fabrics as well.

Operation—FIGS. 1*c* to 1*f*—Donning and Wearing the Brief

When the brief is worn, it is readily apparent by their shapes that the penis is received through entrance opening 26, through the pouch integrating invisible collar into penile pouch 16, and the scrotum is received as well into scrotum pouch 18. Closure hem 38 encircles the proximal end of the genitals, around the base of the penis at the pubic region, at the top and at the perineum, behind the scrotum, at the bottom. The brief is secured on the wearer when the penis is enclosed by pouch 16, the scrotum is enclosed by pouch 18, and closure 38 encircles the periphery of the base of the genitals.

Figure 1C:
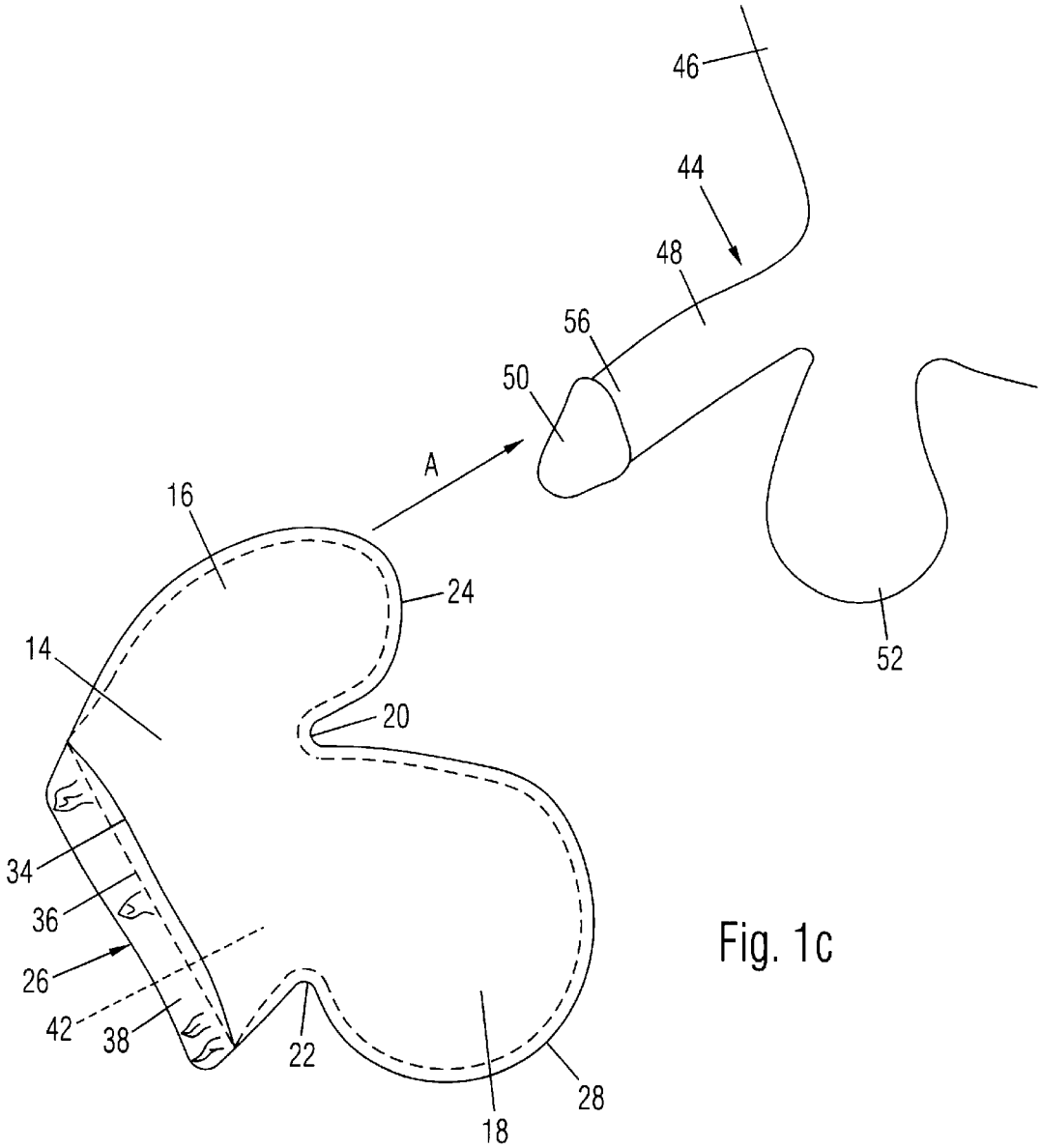
FIG. 1*c* shows a side view of a first step in the method of donning my underwear/swimwear.
Figure 1D:
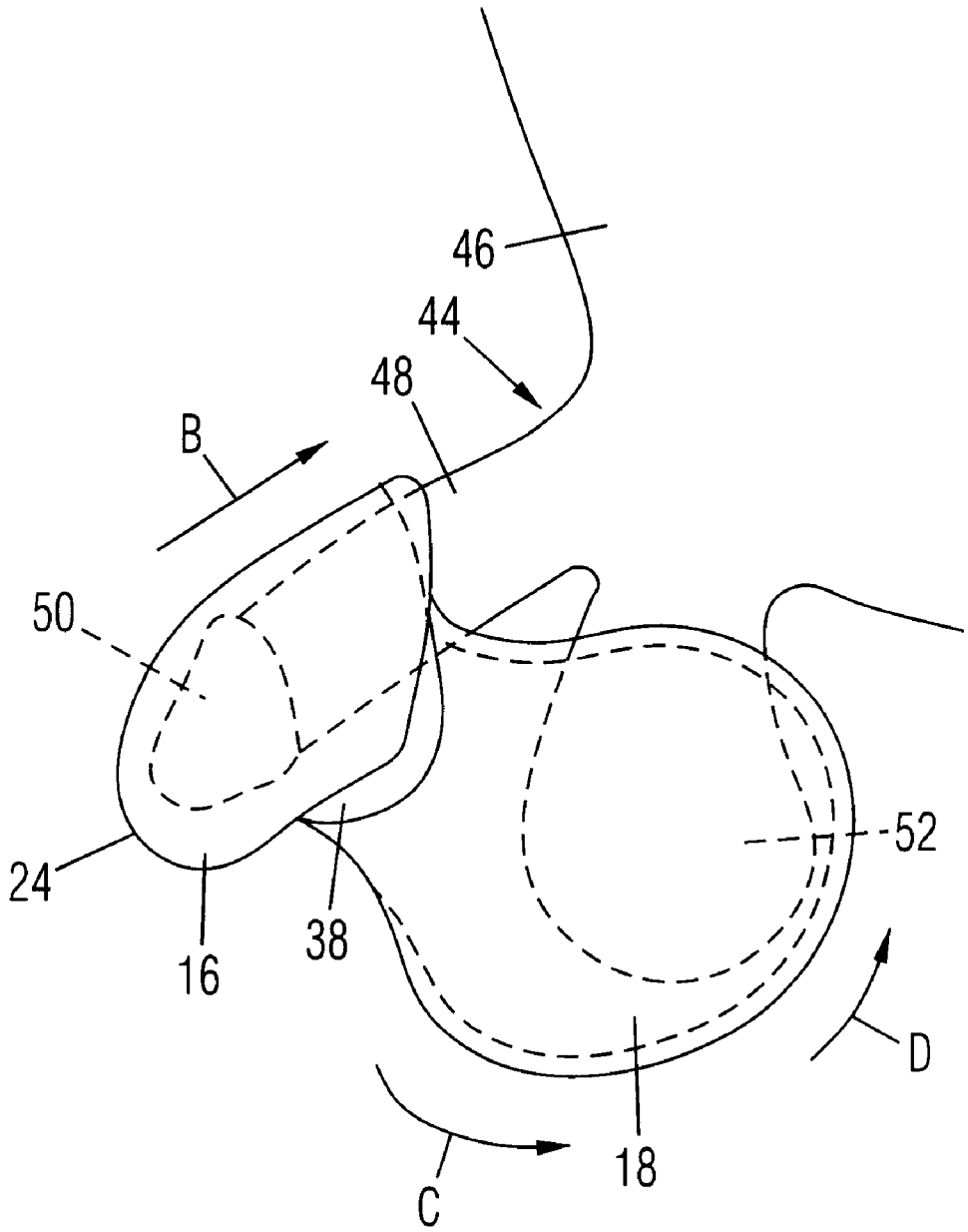
FIG. 1*d* shows a side view of a second step in the method of donning my underwear/swimwear.
Figure 1E:
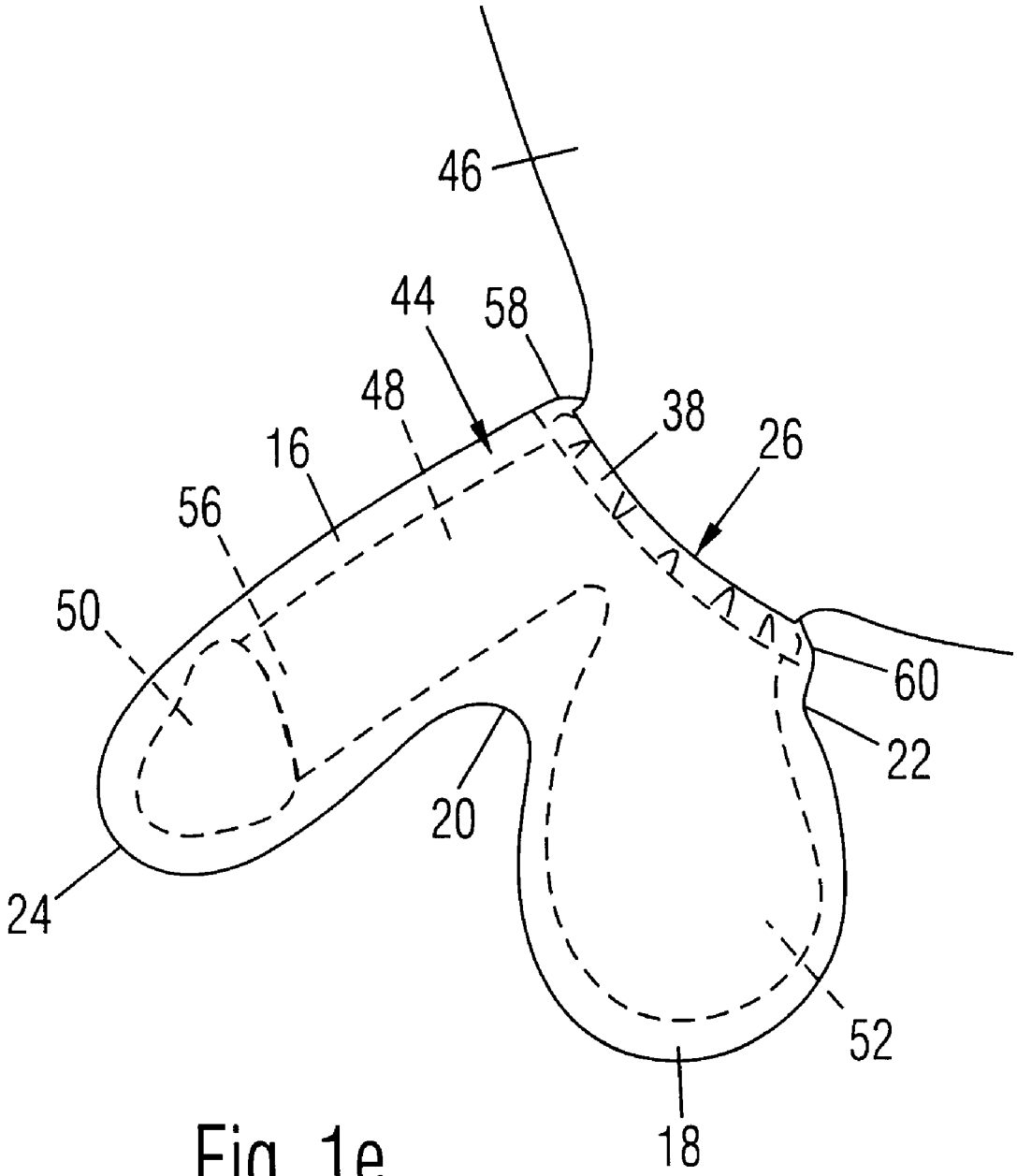
FIG. 1*e* shows a side view at completion of donning my underwear/swimwear.
Figure 1F:
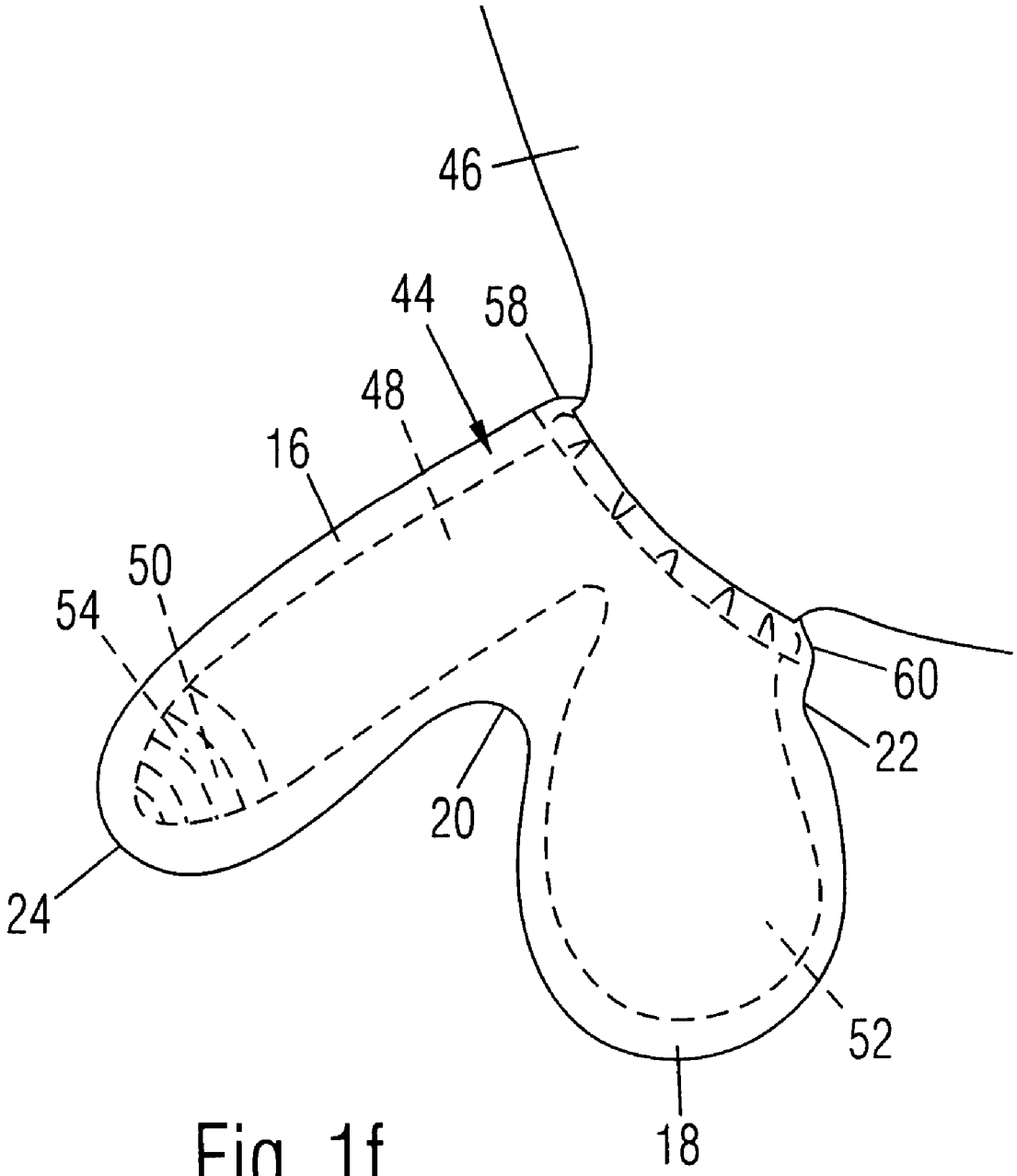
FIG. 1*f* shows a side view as worn, illustrating a glans protecting application of my underwear/swimwear.

FIGS. 1*c* and 1*d* illustrate a preferred method of donning the brief, which will now be explained. Referring first to FIG. 1*c*, male genitalia 44 are shown in diagrammatic form comprising a portion of a male body 46, a penis 48, a glans 50, and a scrotum 52. Initially the brief is turned inside out, thereby exposing interior 42 of penile pouch 16, scrotum pouch 18, closure 38 and stitch lines 28 and 36. In donning the brief, the user places his thumb and two fingers of one hand (not shown) inside pouch 16, while at the same time holding penis 48 with the thumb and index finger of the other hand. An alternative way to hold penis 48, for extra protection of glans 50, is to pull a neck penis skin 54 (FIG. 1*f*) at a glans neck 56 (FIG. 1*c*) over glans 50, while at the same time, with the thumb and first two fingers, hold skin 54 pinched closed over glans 50 (FIG. 1*f*). Referring to FIG. 1*c*, the user brings distal end 24 of the brief towards penis 48 as shown by arrow A and grasps glans 50 through distal end 24 through pouch 16.

In FIG. 1*d* the user unfolds penile pouch 16 over penis 48 as indicated by arrow B. The user then pushes until pouch 16 reaches the base of penis 48 (FIG. 1*e*). While taking care not to allow pouch 16 to slip from the base of penis 48, the user presses with one or both thumbs adjacent an entrance top point 58 of the brief (FIG. 1*e*), then stretches the bottom of closure 38 down, over scrotum 52 until pouch 18 completely encompasses scrotum 52 and closure 38 is in place behind scrotum 52, as indicated by arrows C and D in FIG. 1*d*.

When closure hem 38 encompasses penis 48 all the way up to its pubic base and encompasses scrotum 52 around the sides of the genital periphery, down around the perineum, then the brief completely encloses male genitalia 44, as shown in FIGS. 1*e* and 1*f*. At this point, penis 48 will be enclosed within penile pouch 16, scrotum 52 will be comfortably ensconced in scrotum pouch 18, and the brief will be retained in place by closure hem 38.

FIGS. 1*e* and 1*f*, show the brief being worn. The brief actually fits more closely against the male genitals than is shown; there is no baggy gap between them. Such a gap is shown in the drawings for ease in explanation, to better show the two disparate structures (brief and body), and to prevent confusion as to which is which. Scrotum pouch 18 does not always fit completely snug or tight against scrotum 52. Enough fabric is allowed in the design of pouch 18 for full expansion of scrotum 52. When scrotum 52 is fully expanded, e.g., due to a warm or compressed environment, pouch 18 may appear to be fully filled, but when scrotum 52 is fully contracted, e.g., due to a cold or aroused environment, pouch 18 will have a small amount of space, and i.e., an amount of unfilled fabric at its bottom.

As for penile pouch 16, it is designed to allow a small amount of extra material rolled under closure 38, at entrance top 58, so that when the penis is in an erect state there is more than enough fabric in pouch 16 to accommodate an erect state of penis 48. There will, however, be no appearance of unfilled fabric in pouch 16 at entrance top 58. Pouch 16 is designed to fit penis 48 in a generally conforming—manner; not to be too tight or constricting and not to be lose or baggy. The stretch features of the fabric allows complete expansion, conformity, and comfort for the erect state of penis 48. Donning of the brief is the same for all of the embodiments that follow, except for the non-stretch embodiment below (FIG. 8).

A preferred way to remove the brief is to grasp beneath the scrotum at an entrance bottom 60 (FIGS. 1*e* and 1*f*), pull out and up, and the brief will easily peel off. With this basic embodiment shown in FIGS. 1*a* through 3 the wearer must remove the brief for bodily functions such as urination or ejaculation.

Description—FIG. 2—Exposed Elastic Band Closure

A second embodiment of the brief is shown in FIG. 2 where the hem of entrance closure 38 (FIGS. 1*a* through 1*f*) is eliminated and replaced by a loop of underwear waistband type elastic, which is an exposed elastic closure 62. The second embodiment is preferably constructed from two identical fabric pieces 12*a* and 14*a* and includes a penile pouch 16*a*, a scrotum pouch 18*a*, and an entrance opening 26*a*. Elastic 62 has a soft cloth backing and its preferred width ranges between 0.3 mm to 3 mm. This construction simplifies the retaining mechanism. The name of the brief can be imprinted into elastic 62 and provide the brief with an element of familiarity or product identification for the consumer and the wearer. As shown in FIG. 2, a trademark 63, ANATOMIC, is imprinted in elastic 62. Anatomic is used as an example of a trademark because it is descriptive of the brief and is part of its patent Application title, but is not a registered trademark at the time of filing. This could be a logo imprinted into elastic 62 (not shown) to create an additional element of product identification and familiarity for the consumer. Donning and removing the second embodiment is exactly the same as with the primary embodiment.

Description—FIG. 3—One-Piece Embodiment

A third embodiment of the brief is shown in FIG. 3 where fabric pieces 12 and 14 of FIG. 1 are replaced by a one-piece knit construction 64. In this embodiment there is no stitching together of separate fabric pieces. Knit construction 64 is generally knitted to the same shape as is the primary embodiment with a penile pouch 16*b*, a scrotum pouch 18*b* and an entrance opening 26*b*. Either closure for entrance 26*b* is preferred, whether it is closure hem 38 of FIG. 1*b* or exposed elastic 62 of FIG. 2. The brief employs an exposed elastic closure 62*b*. Examples of clothing which use this one-piece knit construction are socks, panty hose, and knit gloves. The dimensions measurements of construction 64 are the same as for the primary embodiment. The knitting thread used for constructing this third embodiment are the same choices of material blended with the same range of spandex as was described above for the primary embodiment.

On elastic 62*b*, as shown in FIG. 3, is a trademark 63*b*. In this example trademark. 63*b* is shown on both of the lateral sides of elastic 62*b*. In one example trademark. 63*b* is spelled backwards. This is because it is imprinted into elastic 62*b* and being seen from the inside of the elastic. This imprinting can be accomplished in many ways, including, embroidery, silk screening, applique, and various other methods of attaching logos and trademarks to fabric and elastic.

The operation of donning and removing the third embodiment of the brief, one-piece knit construction 64 is the same as donning and removing the primary embodiment.

Description—FIGS. 4*a* to 4*d*—Essential Elements of Fly System

For the purpose of letting the penis out of penile pouch 16 without removing the brief, a fourth embodiment is shown in FIGS. 4*a* through 4*g*. The brief includes a penile pouch 16*c* and a scrotum pouch 18*c* and an entrance opening 26*c*.

Figure 4A:
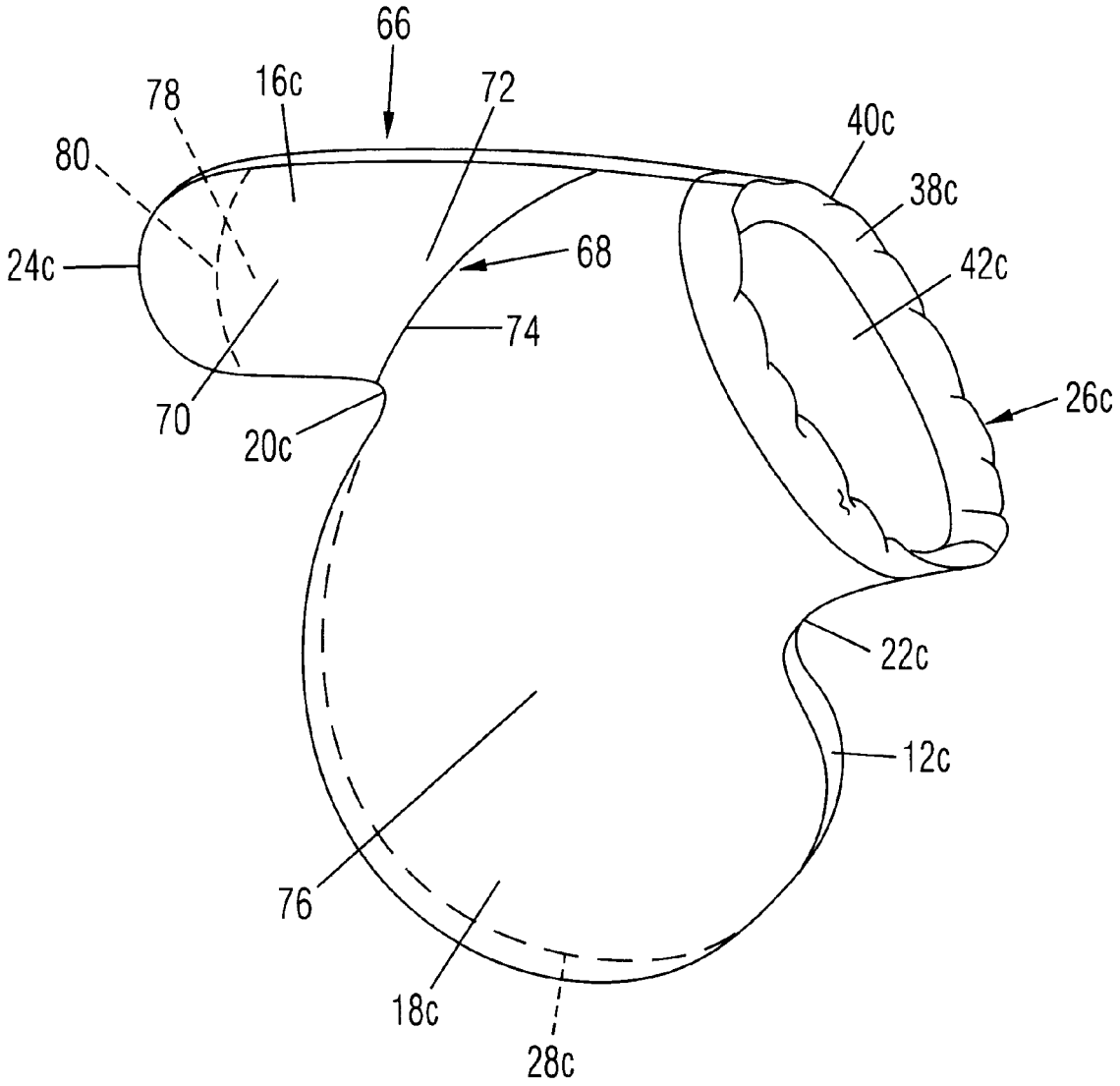
FIG. 4*a* shows an assembled perspective view indicating the essential elements of a preferred fly system, fourth embodiment of my underwear/swimwear.

FIG. 4*a* shows a perspective view which includes a fly system 66, a fly mechanism 66, or a fly assembly 66 which from this point on will be referred to as fly system 66. Fly 66 creates a fly opening 68 on the side of penile pouch 16*c* for allowing the penis out of pouch 16*c* without removing the brief.

Figure 4B:
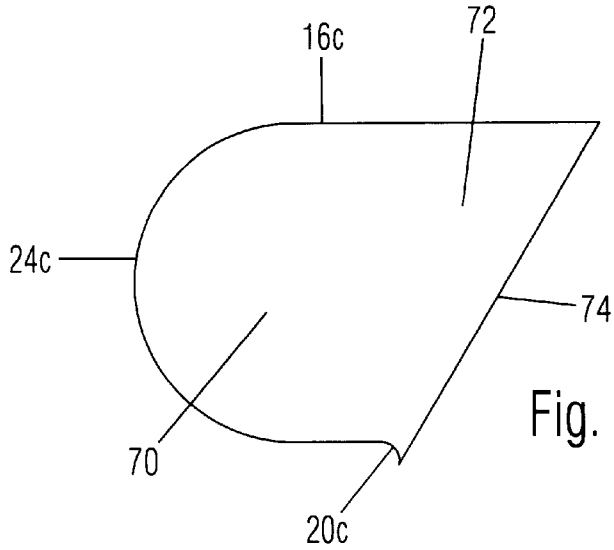
FIG. 4*b* shows a forward overlying tip piece for the assembly of the preferred fly system embodiment in FIG. 4*a*.
Figure 4C:
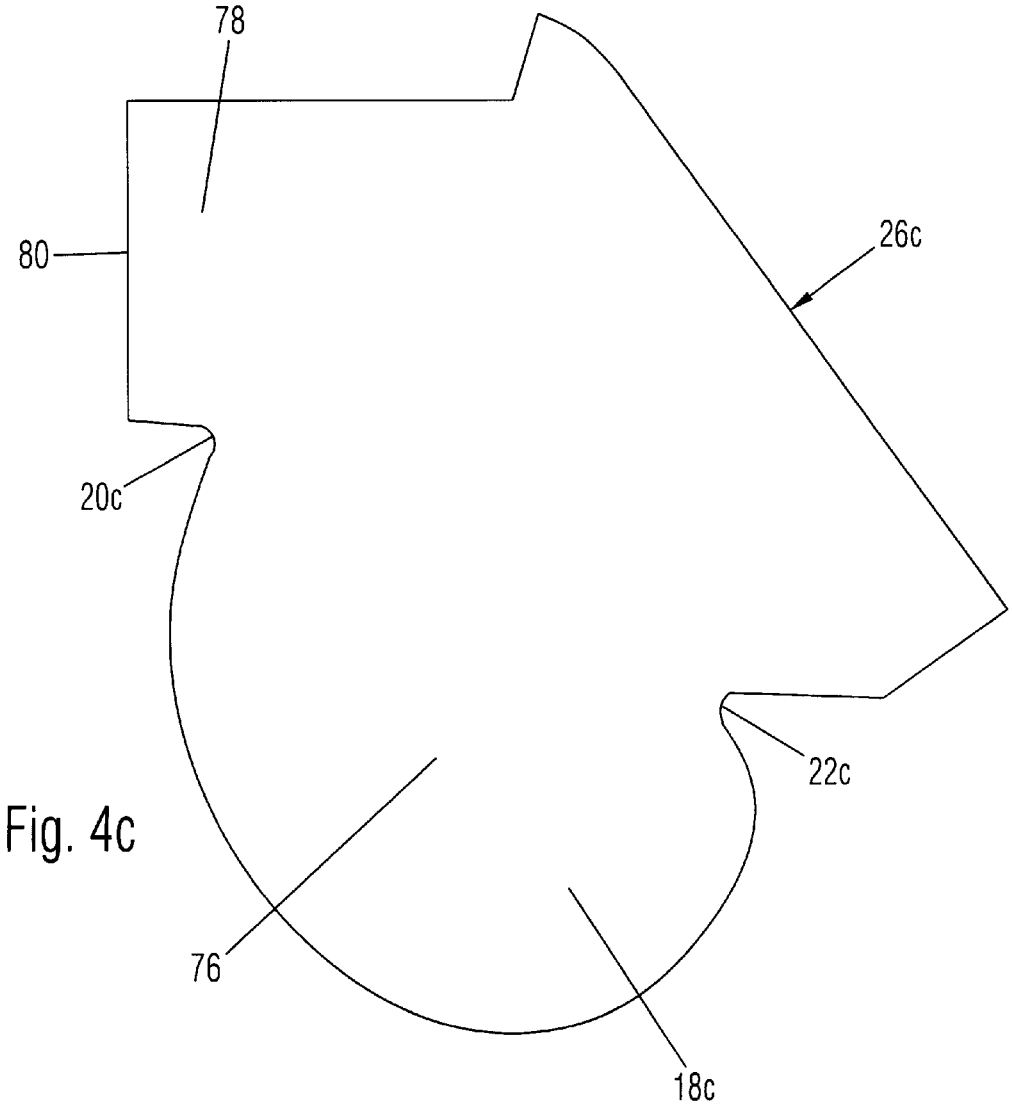
FIG. 4*c* shows a rear underlying piece for the assembly of the preferred fly system embodiment in FIG. 4*a*.
Figure 4D:
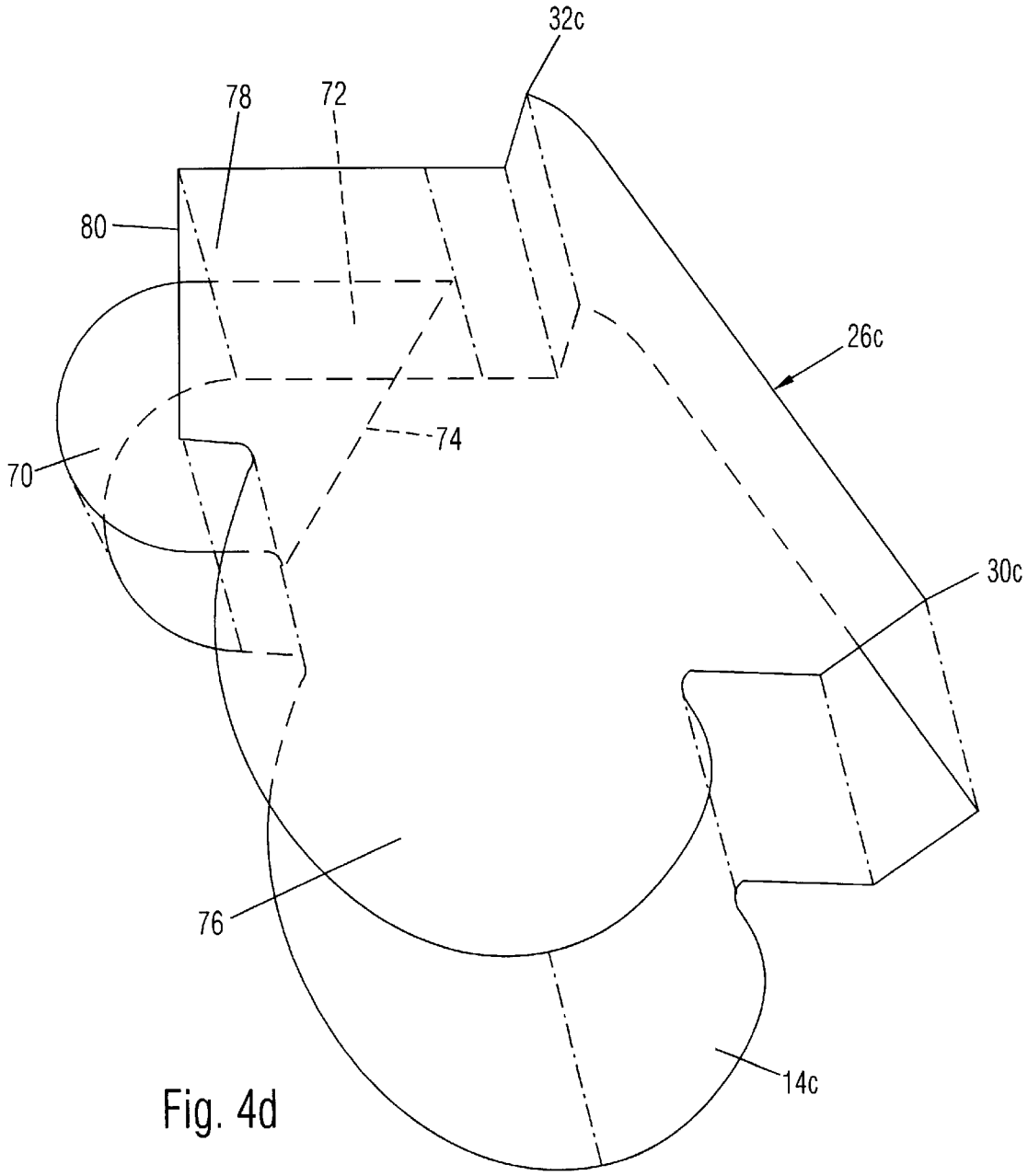
FIG. 4*d* shows an assembly perspective view, illustrating three fabric pieces of the preferred fly system embodiment of my underwear/swimwear in FIG. 4*a*.

FIGS. 4*b* and 4*c* show fly system 66 is formed by converting fabric piece 12*c* into two separate fabric pieces. Matching fabric piece 14*c* remains unchanged. However, either fabric piece 12*c* or 14*c* can be converted, depending upon which side of penile pouch 16*c* one wishes to place fly 66. Thus, fly 66 can be constructed to be on either the right side or the left side of penile pouch 16*c*. For the purpose of functionality, either side is preferable: both work equally as well. In FIG. 4*a*, it is piece 14*c* that is converted, placing fly opening 68 on the left side of pouch 16*c*. In FIGS. 4*b* through 4*g* it is piece 12*c* that is converted, placing opening 68 on the right side of pouch 16*c*.

As shown in FIG. 4*b*, the first cut from fabric piece 12*c*—is a tip piece 70. Piece 70 comprises a portion of penile pouch 16*c*, having a distal end 24*c* and a rear portion 72. It terminates in a diagonally cut rear edge 74. As shown in FIG. 4*b*, rear edge 74 is cut from the bottom of pouch 16*c*, where it meets with scrotum pouch 18*c*, at indentation 20*c* and is cut to the top of pouch 16*c* at a point forward of entrance top 58*c*.

Shown in FIG. 4*c* is the second cut from fabric piece 12*c*—a rear piece 76. Piece 76 is exactly like piece 14*c*, it has a scrotum pouch 18*c* and an entrance opening 26*c*. The only difference is that the forward tip section of penile pouch 16*c* has been cut off, forming forward portion 78. It terminates in forward edge 80.

In assembling this preferred fly system (FIG. 4*d*), tip piece 70 is placed inside-out over the corresponding portion of fabric piece 14*c* which remains unchanged. Then rear piece 76 is placed inside-out over the corresponding portion of fabric piece 14*c*, such that forward portion of piece 76 and forward edge 80 overlies tip piece 70 at its rear portion 72 and rear edge 74. The three pieces are then stitched together along stitch line 28*c* in the usual manner from assembly stitch beginning 30*c* to stitch end 32*c*, as in FIG. 1*a*.

Figure 4E:
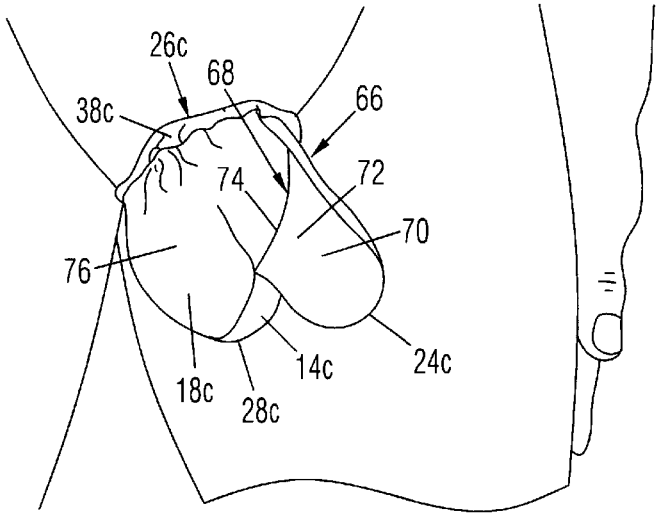
FIG. 4*e* shows a perspective side view as worn, with the preferred fly system embodiment of my underwear/swimwear in FIG. 4*a*.
Figure 4F:
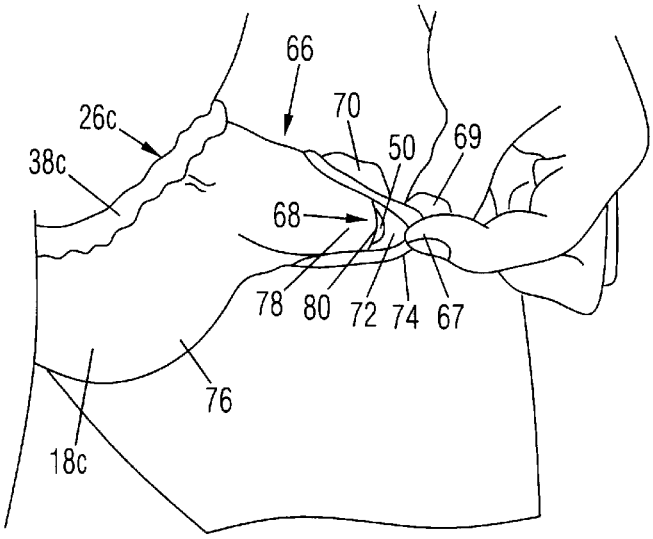
FIG. 4*f* shows a side view as worn, demonstrating the opening of the preferred fly system embodiment of my underwear/swimwear in FIG. 4*a*.
Figure 4G:
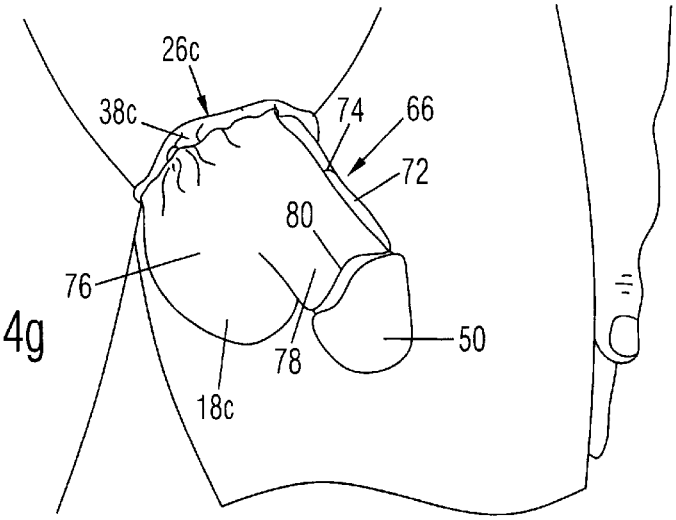
FIG. 4*g* shows a side view as worn, demonstrating the opened preferred fly system embodiment of my underwear/swimwear in FIG. 4*a*.

The brief is then turned outside-out and the result is the construction shown as worn in FIGS. 4*e* through 4*g*. Rear edge 74 of tip piece 70 is exposed and forward edge 80 and forward portion 78 of rear piece 76 lie underneath rear portion 72 of tip piece 70. The perspective view of FIG. 4*a* shows that the overlapping of tip piece 70, on top of forward portion 78 of rear piece 76 creates preferred fly system 66 and fly opening 68.

Additionally, a closure stay (not shown) for fly opening 68 can be included in the assembly. The stay is attached to the inside of tip piece 70 at rear portion 72 directly forward of rear edge 74. The stay is attached to the outside of rear piece 76 at the most rear area of forward portion 78. The stay helps to hold edge 74 of tip 70 flat against portion 78 of piece 76. Materials that can achieve the purpose of a stay are buttons, snaps, hook-and-loop fasteners, lingerie hooks and loops, and a zipper channel. Another possible way for rear edge 74 to maintain its shape and stay flat is to install a narrow strip of elastic inside the hem of rear edge 74 (not shown). Edges 74 and 80 must include a standard fabric pattern allowance for hemming their respective edges. This method has been applied to prototype models and creates a flat lying rear edge 74, which also has all of the stretch characteristics necessary for the brief to perform its conforming features.

Operation—FIGS. 4*e* to 4*g*—Opening & Closing Fly System 66

FIGS. 4*e*, 4*f* and 4*g* show, as worn, the operation of letting the penis out of penile pouch 16*c* of preferred fly system 66 and through fly opening 68 without having to remove the brief. FIG. 4*e* shows the preferred embodiment of the brief utilizing preferred fly system 66 as worn.

Proper operation for opening fly system 66 is shown in FIG. 4*f*. First the user unclasps the stay (not shown). The user places his forefinger inside fly opening 68. The user pinches and holds rear edge 74 and portion 72 between forefinger and thumb, then simply pulls open tip piece 70, turning tip piece 70 inside out while pulling it across the front of glans 50 until it lies inside out on the opposite side of pouch 16*c* (FIG. 4*g*). This opens pouch 16*c* and allows glans 50 to come out, unfettered.

To close, the user grips tip piece 70 at its rear edge 74 and pulls back, across the front of glans 50 into its original position (FIG. 4*e*). Alternately, for the medical purpose of protecting a circumcised penis, the user pushes glans 50 inside penile pouch 16*c* and pinches penis skin 54 (FIG. 1*f*) over glans 50. Grip tip piece 70 at its rear edge 74 and pull back across glans 50, into its original position (FIG. 4*e*). Penis skin 54 will be held over glans 50 by the conforming fit of pouch 16*c*.

The operation of donning and removing the fourth embodiment of the brief is the same as donning and removing the primary embodiment.

Figure 5:
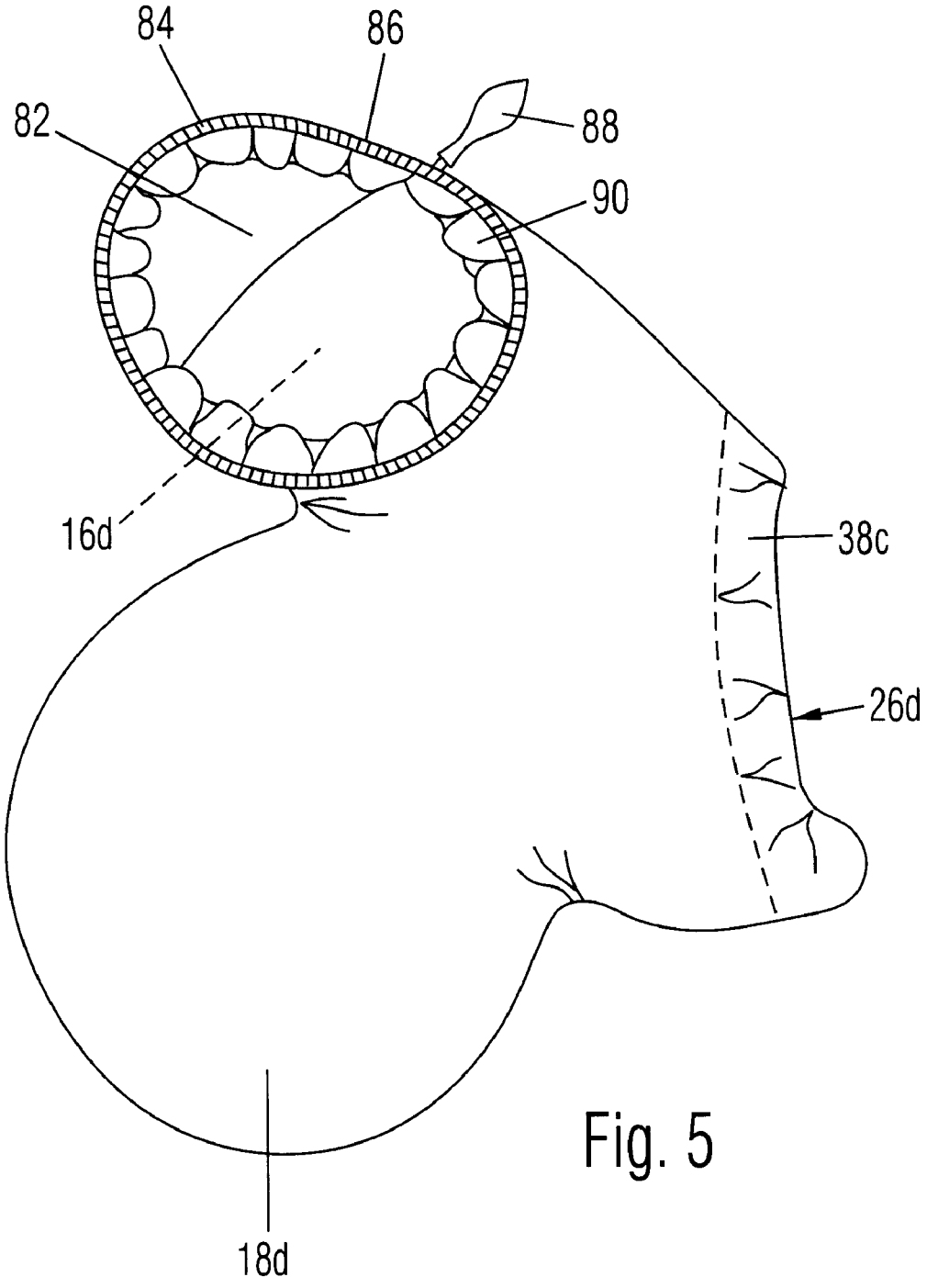
FIG. 5 shows a mostly side view of a distal end closure, fifth embodiment of my underwear/swimwear.

Description—FIG. 5—Distal End Closure

FIG. 5 shows a perspective view of a fifth embodiment of the brief. As before, the brief comprises a penile pouch 16*d* and a scrotum pouch 18*d*. This fifth embodiment differs in that distal end 24 of FIGS. 1*a* and 1*b* has a distal end opening 82, which is selectively opened and closed by a closure means, e.g., a zipper 84. Zipper 84 includes the usual teeth 86 and a zipper pull tab 88. Alternately, zipper 84 may be made of a soft plastic channel instead of teeth. Other closures for closing distal opening 82 can be substituted for zipper 84, such as snaps, buttons, drawstring, hook-and-loop fastener, pull tabs, lingerie hook and loop etc. (all not shown). Incidentally, shown in FIG. 5 are an internal folds 90 produced by hemming distal opening 82 when attaching zipper 84.

Operation—FIG. 5—Distal End Closure

When necessary, the user unzips zipper 84 to open distal end opening 82. This obviates the need to completely remove the brief before urinating. The same is true no matter the closure mechanism used, whether it is snaps, buttons, drawstring, hook-and-loop fastener, pull tabs, lingerie hook and loop etc. (all not shown). To close opening 82 the user closes zipper 84. The operation of donning and removing the fifth embodiment of the brief is the same as donning and removing the primary embodiment.

Figure 6:
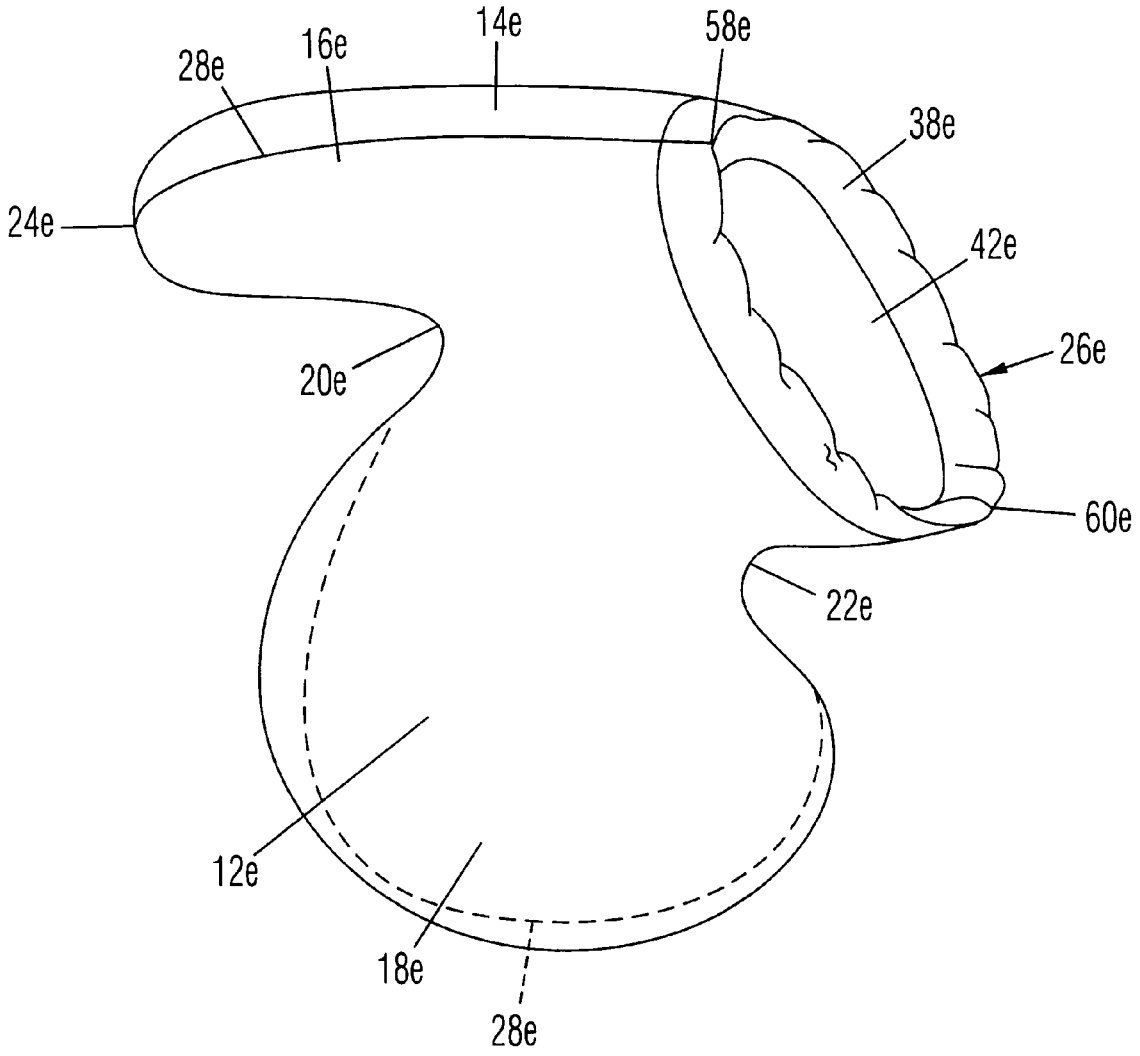
FIG. 6 shows a perspective side view of a sixth embodiment with extreme indentations of my underwear/swimwear.

Description—FIG. 6—Extreme Indentations

In a sixth embodiment, shown in FIG. 6, indentations 20*e* and 22*e* are more extremely pronounced than those shown in the previous embodiments. In this embodiment, indentations 20*e* and 22*e* are more deeply indented into the garment, causing a more distinct separation between penile pouch 16*e* and scrotum pouch 18*e*. This embodiment allows pouch 16*e* to be pulled off the penis by moving entrance top 58*e* down to indentation 20*e*. This exposes the penis for urinating, while scrotum pouch 18*e* holds the brief on the wearer around the scrotum.

Another method for making the sixth embodiment is to stitch a narrow strip of elastic (not shown) into fabric pieces 12*e* and 14*e*, running from indentation points 20*e* to 22*e*. This elastic strip will pull indentations 20*e* and 22*e* closer together and thereby create a more distinct separation between penile pouch 16*e* and scrotum pouch 18*e*. This will, in turn, aid in releasing the penis from pouch 16*e* when dropping pouch 16*e* from entrance top 58*e* down to indentation point 20*e* without completely removing the brief. Such an elastic tightening strip may be applied to any of the embodiments discussed in this application.

An additional method for creating a more pronounced separation between penile pouch 16*e* and scrotum pouch 18*e* will be shown in FIGS. 9*a* and 9*b* below.

Description—FIGS. 7*a* through 7*e*—Modification to Prior-Art Design

Figure 7A:
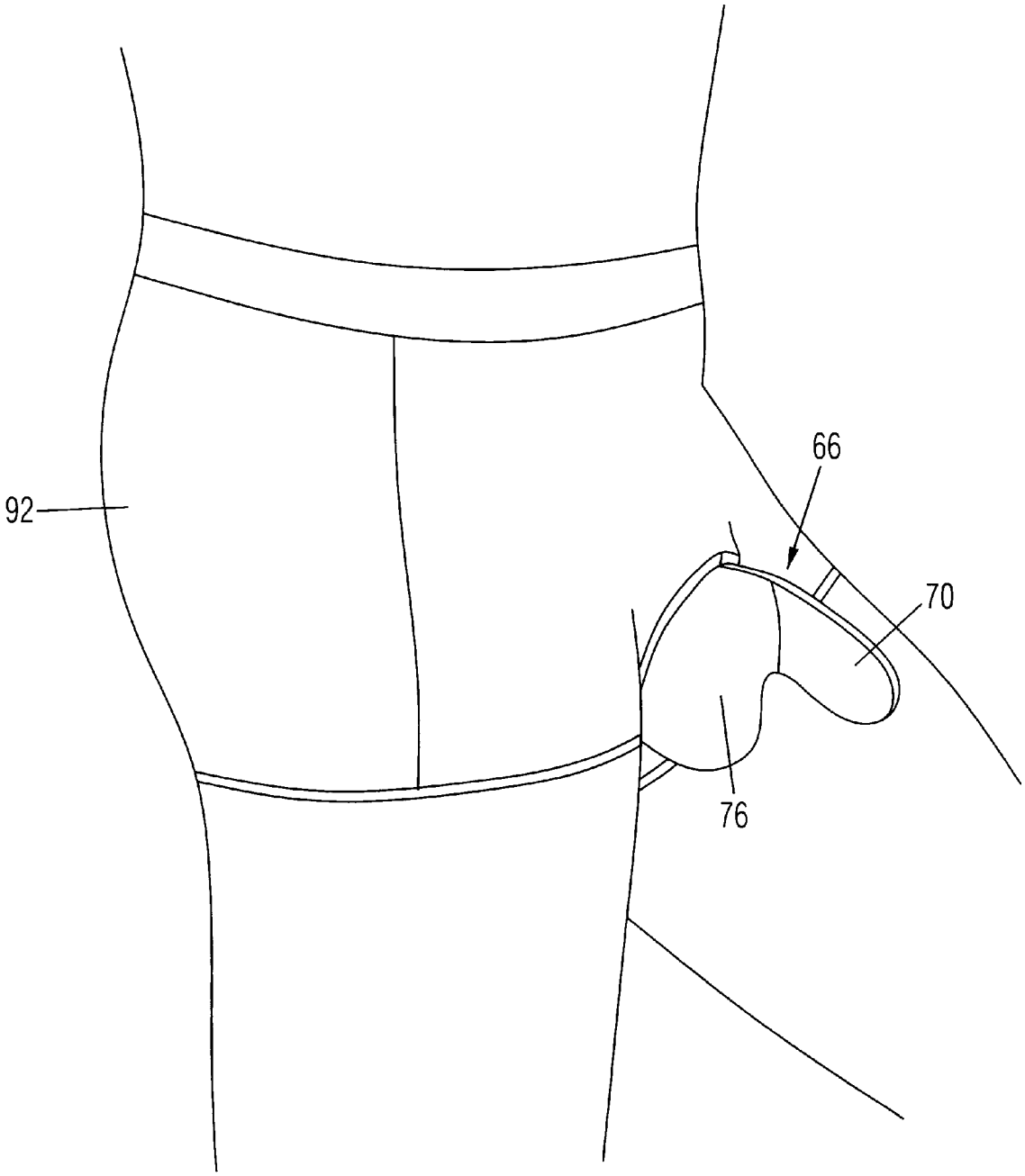
FIG. 7*a* shows a three-quarter side view, as worn, of a seventh embodiment of my underwear/swimwear; this embodiment provides an inventive modification to a prior-art design.

FIGS. 7*a*–7*e* illustrate a seventh embodiment of the brief. FIG. 7*a* shows a view, as worn, of the seventh embodiment. Here the brief is incorporated into a conventional underwear 92 by modifying the crotch portion of underwear 92. This modification can be applied to any conventional underwear style. Conventional men's underwear, whether it is briefs, bikinis, athletic supporters, thongs, boxers, fitted boxers, or swimwear and sunwear, as an industry standard, typically includes a single front pouch or a front crotch panel, which normally covers the male genitals. In this example the conventional underwear is a fitted boxer style of men's underwear modified with fly system 66 of the brief as shown in FIG. 7*a*. However, any of the embodiments of the brief or combinations of embodiments can be used. For the conventional modification, fly 66 is the preferred underwear embodiment.

As described above, the brief is uniquely different from conventional underwear and swimwear styles in that it is designed to generally conform to the shape of the male genitals, to hold, cover, contain, and support them in their correct shapes and contours. The brief is attached to any and all styles of conventional underwear and swimwear in the general area where their respective crotch panel or crotch pouch would ordinarily be positioned.

Figure 7B:
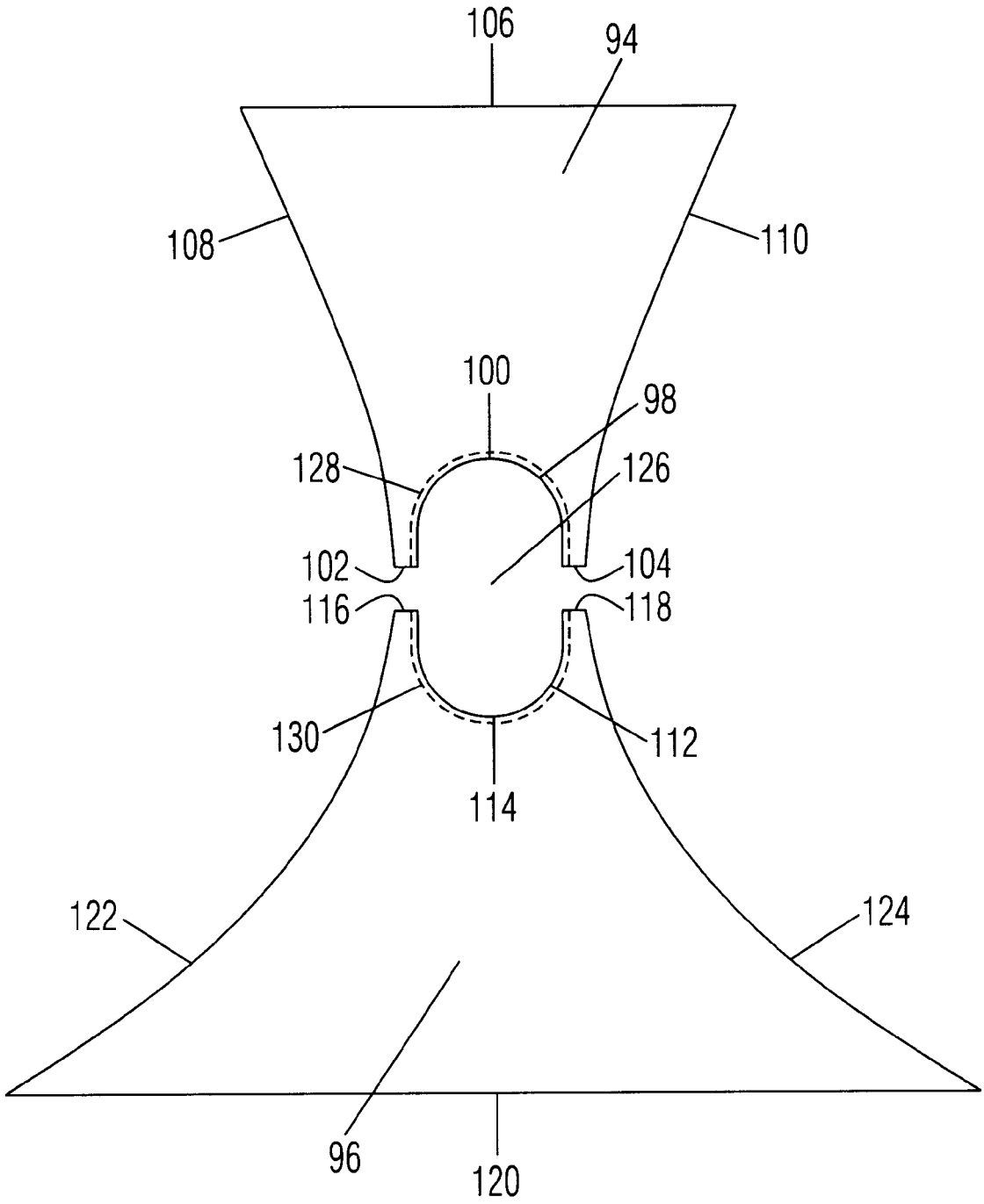
FIG. 7*b* shows a top view of two fabric pieces, a front and a back panel; which are used in the seventh embodiment to assemble a modification to a prior-art design.

FIG. 7*b* is a top view showing one possible way to construct the brief into one style of conventional underwear. The main idea is to replace the crotch panel or pouch of conventional underwear and swimwear with the brief, there are inevitably many ways to construct this modification, the following illustrates one such way.

Two pieces of fabric, i.e., a front fabric panel 94 and a rear fabric panel 96, are used in this construction example. Panel 96 is wider than panel 94 because it is designed to cover the buttocks. Panel 96 would not be wider if the conventional underwear being modified with the brief did not have a buttocks cover. Two examples of a conventional underwear without a buttocks cover are athletic supporters, and thongs. Front panel 94 includes a vertically oblong semi-circular bottom edge 98 with a center point 100. Additionally there are two tabs on each side of semi-circular bottom edge 98, a front connecting tab 102, and a front connecting tab 104. Panel 94 also has a straight top edge 106, a gently inwardly curved side edge 108, and a gently inwardly curved side edge 110.

Continuing with FIG. 7*b*, the same as front fabric panel 94, rear fabric panel 96 also includes a vertically oblong semi-circular bottom edge 112, with a center point 114, a rear connecting tab 116, and a rear connecting tab 118. Panel 96 also includes a straight top edge 120, an inwardly curved side edge 122, and an inwardly curved side edge 124 that are preferably more sharply curved than side edges 108 and 110 of front panel 94.

Conventional underwear and the brief are modeled as two modular units that are connected and fabricated as a one-piece underwear or swimwear garment. To assemble, front fabric panel 94 and rear fabric panel 96 are positioned outside-in so that front connecting tabs 102 and 104 are aligned with rear connecting tabs 116 and 118 respectively. Front tab 102 and rear tab 116 are then stitched together, forming a seam (not shown); likewise, front tab 104 and rear 118 are stitched together, forming another seam (not shown). Then front semi-circular edge 98 and rear semi-circular edge 112, together, form an aperture 126 for accommodating the brief.

Figure 7C:
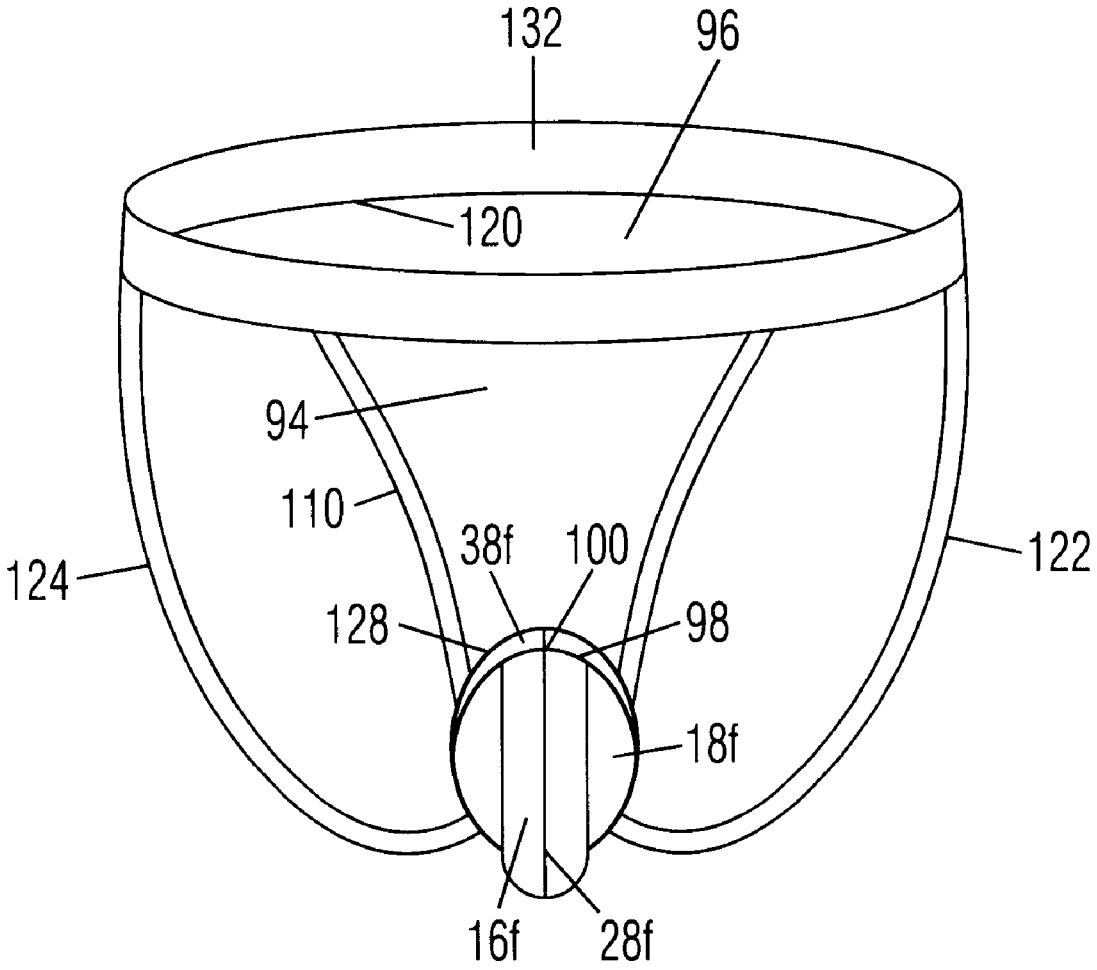
FIG. 7*c* shows an assembled front view of my underwear/swimwear; which displays a modification to a prior-art design, seventh embodiment.
Figure 7D:
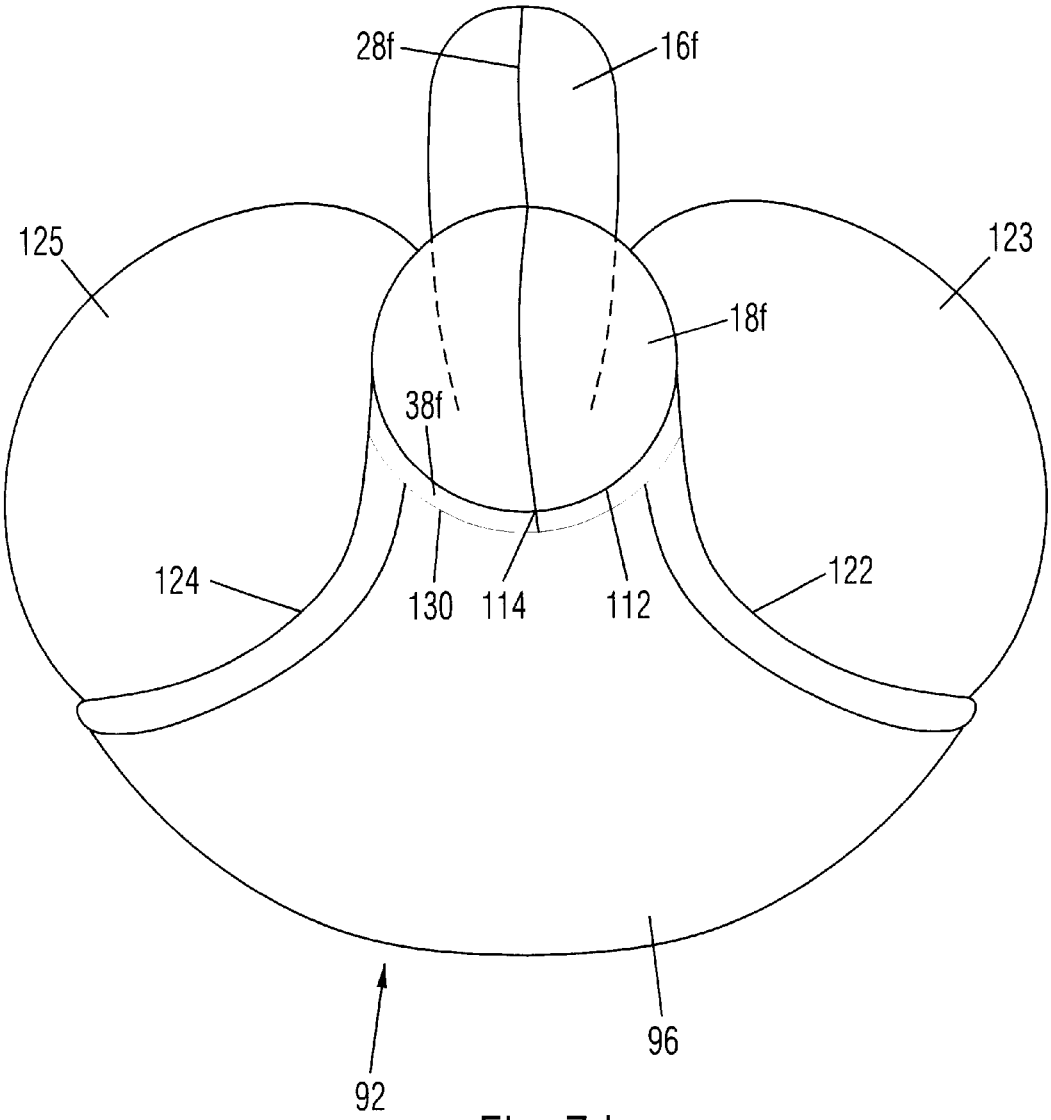
FIG. 7*d* shows a bottom view of my underwear/swimwear; which displays a modification to a prior-art design, seventh embodiment.
Figure 7E:
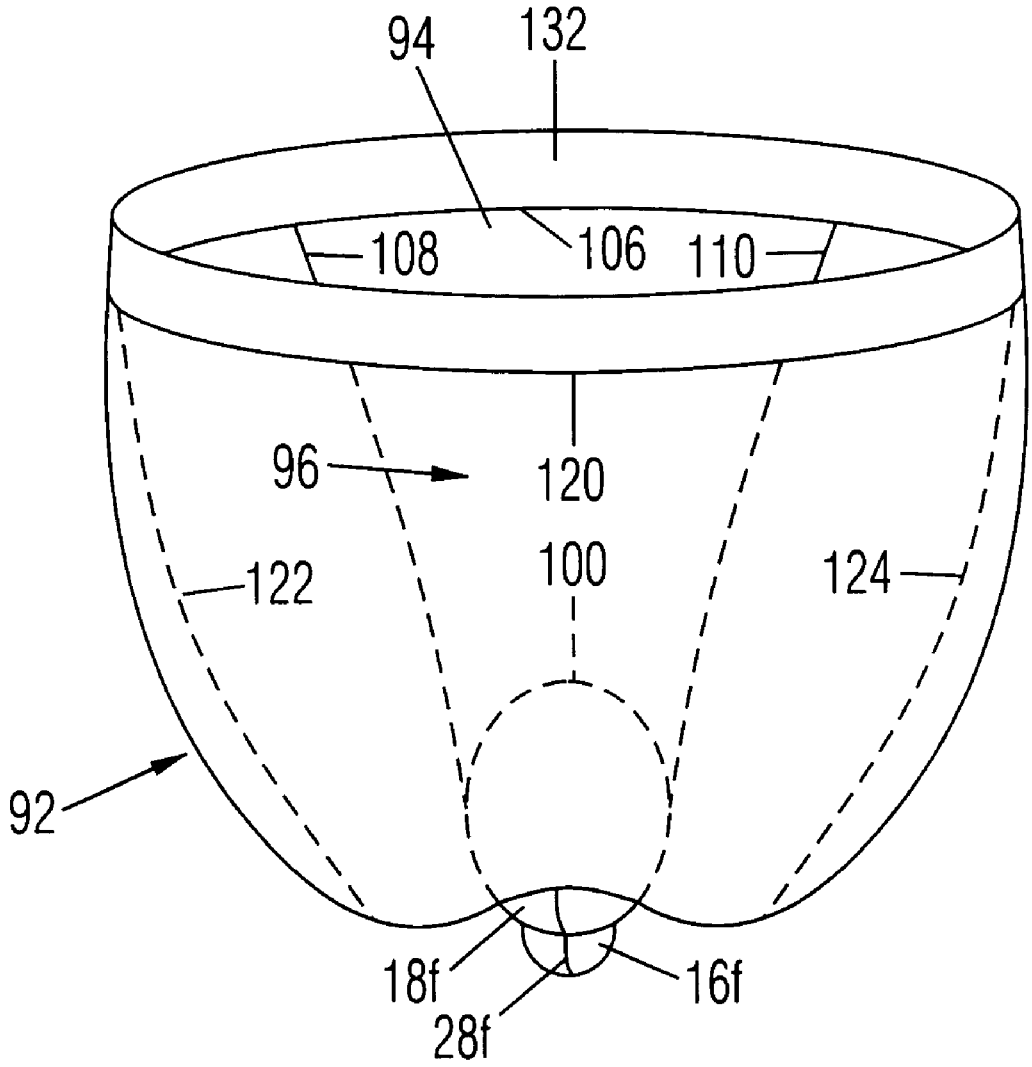
FIG. 7*e* shows a rear view of my underwear/swimwear; which displays a modification to a prior-art design, seventh embodiment.

To adjoin the brief with conventional underwear, the brief is preferably pulled inside-out and inserted through aperture 126 from the outer side of the adjoined fabric panels 94 and 96, to their inner side. FIG. 7*c*, an assembled front view, shows the brief oriented in aperture 126 where assembly stitch line 28*f* of the brief is aligned with center point 100 of front panel 94. Simultaneously, as shown in FIG. 7*d*, an assembled bottom view, the bottom of the brief is oriented in aperture 126 where stitch line 28*f* of the brief is aligned with center point 114 of rear panel 96. The brief is then attached in aperture 126 to adjoined fabric panels 94 and 96 by sewing along stitch line 36*f* of the brief, along a front aperture stitch line 128 of front fabric panel 94, and along a rear aperture stitch line 130 of rear fabric panel 96 as shown in FIGS. 7*b*, 7*c* and 7*d*. Next, top edge 106 of panel 94 and top edge 120 of panel 96 are sewn to a waistband 132 as shown in FIGS. 7*a*, 7*c* and 7*e*. The conventional underwear is then pulled outside-out and then the brief is pulled outside-out through aperture 126 and it is ready for the user to don.

Operation—Donning Modification to Prior-Art design

This brief is donned by first pulling-on the conventional styled garment as is usually done; putting one's legs through the leg holes, one at a time, pull it all the way up, and adjusting the waistband. Then the brief is donned in the usual manner as is described in the primary embodiment above. Alternately the brief can be made to have a loser fit than in the previous embodiments which will allow the genitals to slip easily into the brief without having to go through the process of donning as stated above. Fly system 66 operates exactly the same as was described above in FIGS. 4*e* through 4*g*.

The seventh embodiment offers the consumer a more customary alternative to the brief by modifying the very familiar conventional male underwear and swimwear garments as a starting point for the consumer to become familiar with the brief. It also offers those who are inclined to be more modest and traditional with a brief which appears to be more conventional. Additionally, with waistband 132 and rear panel 96, it will feel more conventional and have a more customary aesthetic for the user. This modification is not for the purpose of functionality of the brief, but for the purpose of attracting the mainstream consumer market to the brief. Because of this modification, the wearer will experience the very new, unexpected breakthrough comfort and support technology that is inherent in the design of the brief. Yet, the user still has the familiar buttocks portion cover and waistband to which he is accustomed. It is therefore to be understood that the seventh embodiment may be practiced otherwise than as specifically described.

Description—FIG. 8—Non-Stretch Embodiment

Illustrated in FIG. 8 is an eighth preferred embodiment which uses a non-stretch material. The fabric make-up of the brief is not limited to using knit, spandex, or any other fabric containing polyurethane fiber. This brief is designed for use with all non-stretch fabrics as well. These fabrics include, but are not limited to, leather, fake leather, animal furs, fake furs, plastic, cellophane, non-stretch vinyl, any of the various number of wovens or any other chosen non-stretch material. The same reference numerals will indicate the same elements as the primary-embodiment in FIGS. 1*a* and 1*b*. As before, the brief comprises two fabric pieces 12*g* and 14*g*, penile pouch 16*g*, scrotum pouch 18*g*, outer indentation point 20*g*, inner indentation point 22*g*, and distal end 24*g*. Because this brief has a different entrance opening, new reference numerals will be assigned below.

In this embodiment in FIG. 8, entrance opening 26 of the primary embodiment (FIG. 1*b*) is modified into a non-stretch entrance opening 134. As shown in FIG. 8, this non-stretch embodiment is assembled by placing fabric pieces 12*g* and 14*g* face-to-face, inside-out and sewn together at their perimeter with an assembly stitch 28*g*. Assembly stitch 28*g* starts at an assembly stitch beginning 136 and ends at an assembly stitch end 138. Non-stretch entrance 134 is made larger by stitch end 138 ending mid-way on penile pouch 16*g*, before it reaches assembly stitch end 32 of the primary brief shown in FIG. 1*a*. Non-stretch entrance 134 enlarges the entrance opening at the top seam of pouch 16*g* so the penis and the scrotum fit easily into this embodiment. After the male genitals have entered the brief, a top closure zipper 140 is zipped closed by pulling zipper pull tab 142 until it reaches a closure end point 144. This non-stretch embodiment can employ many possible devices to use as a closure for the top seam opening of entrance 134. Among these possible closure devises are a zipper, buttons, buttons-and-loops, lingerie hook-and-loops, frog closure, string lace tie, snaps, hook-and-loop fastener, or any of the other garment connecting assembly.

As a result of stitch line 28*g* ending at assembly stitch end 138 in FIG. 8, entrance closure 38 in FIG. 1*b* can no longer provide a continuous loop for housing a strip of clothing elastic to act as a closure. Created now is an entrance closure hem 146 which has a right hem opening 148 and a left hem opening 150. This is an opportune time to insert an entrance closure belt 152, with a belt buckle 154 into entrance hem 146 for the purpose of securing the brief around the periphery of the genital base on the wearer. There are many other possible devices to use as an entrance closure, a chain closure, drawstring closure, an elastic attached to a belt closure, hook-and loop-fastener attached to a belt or an elastic strip, or any of the other garment tightening and closing device.

The size and dimensions of fabric pieces 12*g* and 14*g* varies depending upon the grade being constructed. The following measurements are for the genitalia in their flaccid state. The length of penile pouch 16*g* of pieces 12*g* and 14*g* can vary greatly. Measuring from entrance opening 134, through the center of pouch 16*g*, to the tip of distal end 24*g*, the length can range from 5 mm to 20 mm. If the penis being fitted requires it, or if an augmented look is desired it can be made even longer. The width of pieces 12*g* and 14*g* at pouch 16*g* of varies between 3 mm and 9 mm. When sewn together the circumference of pouch 16*g* varies between 6 mm and 18 mm. Again, this measurement depends upon the penis being fit or the augmented look the user is attempting to achieve. Scrotum pouch 18*g* of pieces 12*g* and 14*g* form an irregular circumference. Measuring from a center point which lies half way between indentations 20*g* and 22*g*, the radius ranges from 4 mm to 12 mm, depending on the point of the circumference being measured, the scrotum being fit, and the possible augmented look a wearer is trying to achieve. The width of entrance 134 ranges from 6 mm to 14 mm for each piece 12*g* and 14*g*. When sewn together and closure belt 152 is buckled, entrance closure 146 has a circumference from 12 mm to 28 mm around.

The example used in FIG. 8 represents the proportions of a medium size for penile pouch 16*g*, scrotum pouch 18*g*, and entrance 134. Since all men are different in growth, it is possible, if not probable, to have a combination of sizes in one embodiment, e.g., a large pouch 16*g*, with a small pouch 18*g*, and a medium entrance 134.

This embodiment will not conform to the contours presented by the shifting of genital sizes. The non-stretch brief can be made larger than the user's actual genitals sizes so that the genitals can shift in size without becoming cramped inside the brief. An embodiment made with non-stretch material is used more for a desired look than for its conforming functionality. This desired look is achieved whether one prefers to be seen in a material such as leather, fake leather, animal furs, fake furs, plastic, cellophane, non-stretch vinyl, any of the various number of wovens or any other chosen non-stretch material. Additionally this embodiment will work with fabrics that only have a slight stretch, or a one-way stretch. The major advantage to wearing this embodiment is that the wearer gets the natural masculine styling of the brief. This masculine styling, in many cases, is preferable to the constricted and bundled-up, brief pant look of conventional underwear.

Operation—FIG. 8—Donning Non-Stretch Embodiment

To don this non-stretch embodiment, the user unzips top seam opening zipper 140 from closure end point 144 to assembly stitch end 138. As with the primary embodiment it is readily apparent by their shapes that the penis is received through entrance 134 into penile pouch 16*g* and the scrotum is received into scrotum pouch 18*g*. After the penis and the scrotum are ensconced in their respective pouches, zipper 140 is pulled closed, and belt 152 is looped through buckle 154 and tightened enough to comfortably hold the brief on the wearer. To remove the brief the wearer unbuckles belt 152 from buckle 154, unzips top closure zipper 140, and pulls the brief away from the body, removing it from the genitals.

Figure 9A:
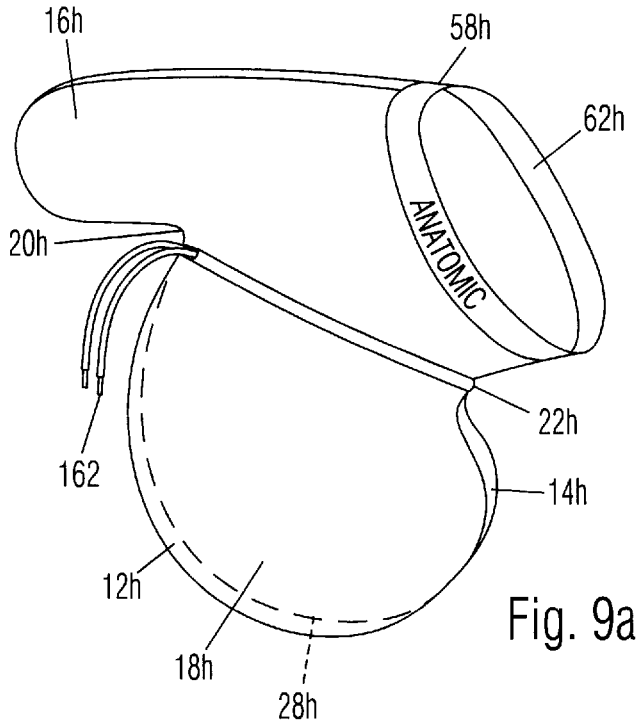
FIG. 9*a* shows a perspective view my underwear/swimwear with an indentation tightening system, ninth embodiment.
Figure 9B:
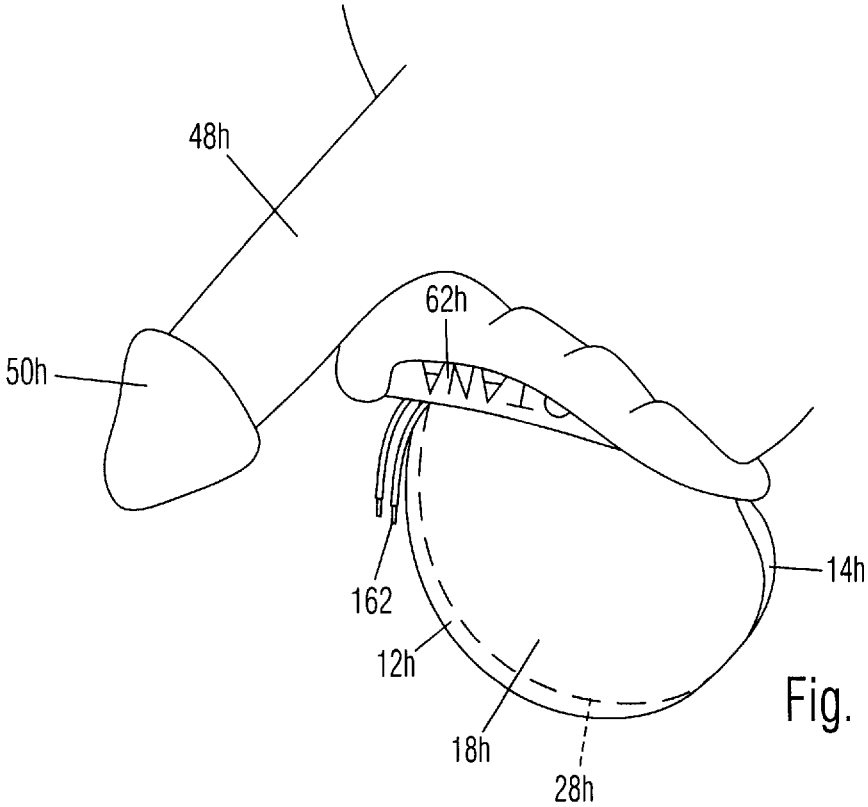

Description—FIGS. 9*a* & 9*b*—Indentation Tightening System

FIGS. 9*a* and 9*b* show a ninth embodiment, illustrating another method to obviate the need to completely remove the brief before urinating. This embodiment contains a system that is used to create more deeply pronounced indentations 20 and 22, for making a greater separation between penile pouch 16 and scrotum pouch 18, as was shown in FIG. 6.

FIG. 9*a* shows a narrow fabric channel 156 stitched into fabric pieces 12*h* and 14*h*. Channel 156 is stitched into piece 12*h* beginning at indentation 20*h*, running down to indentation 22*h*, extending continuously around to fabric piece 14*h* and continuing to stitch up to indentation 20*h*. Channel 156 has an opening 158 at indentation 20*h* on piece 12*h* and an opening 160 (not shown) at indentation 20*h* on piece 14*h*. A drawstring 162 is inserted into channel 156, running continuously from opening 158 to opening 160.

Operation—FIG. 9*b*—Using Indentation Tightening System

When the user wishes to release the penis from penile pouch 16*h* and not completely remove the brief, drawstring 162 is tightened and tied. The tightening of drawstring 162 cinches the brief by securing scrotum pouch 18*h* to the scrotum of the wearer. Then, as shown in FIG. 9*b*, pouch 16*h* is dropped from entrance top 58*h* down to indentation point 20*h*. This frees the penis from pouch 16*h* for urinating. To reposition pouch 16*h*, entrance top 58*h* is pulled back to its original position and drawstring 162 is untied and loosened. Loosening drawstring 162, allows indentations 20*h* and 22*h* to return to their original positions, this allows pouch 18*h* to return to its conforming shape, and thereby allows the brief to naturally conform to the wearer's genitalia. Both pouches 16*h* and 18*h* will provide all of their normal properties of conformity, comfort, and support.

Description—FIG. 1*f*—Circumcised Protection

As mentioned above, FIG. 1*f* illustrates the result of the preferred method of wearing the brief when neck penis skin 54 is pulled over glans 50 prior to enclosure by penile pouch 16. In this manner, glans 50 is afforded extra protection, skin 54 will become slightly stretched and retrained to be more like a foreskin (over the long term), and will cover glans 50. As a result, skin 54 and glans 50 will become more sensitive. This can be considered as both a preferred method of donning and wearing, and as a medical application of the brief. This medical application better protects a circumcised glans, and it does stretch and retrain skin 54 to cover glans 50. This method of wearing the brief is used with any and all of the embodiments described above, whether it is swimwear or sunwear, or fly system 66, or any of the above embodiments.

Description—Testes Protection Device

There is yet another medical application of the brief. Because of the conforming fit and non-constrictive, non-compacting, non-compressing technology of the brief, scrotum pouch 18 may be used for aiding the health of sperm cells in men. Urologists and fertility specialists may prescribe the brief as an underwear that will allow scrotum 52 to regulate its temperature through its natural function of expanding and contracting. As a result the brief will not interfere with the body's maintenance of sperm viability or vitality, and will therefore assist in maintaining a man's fertility.

Description—Penile Augmentation Device

In a still further embodiment (not shown), penile pouch 16 is cut from a pattern which is longer in length and perhaps larger around in circumference. With this alteration the brief can accommodate a penile prosthesis or a filler, which would extend the length, the circumference, and the look of pouch 16. This results, for example, in penile enhancement. This is considered an augmentation embodiment or a cosmetic embodiment.

Conclusion, Ramifications, and Scope

By addressing the design to the two primary and uniquely different shapes of the male genitalia, my underwear/swimwear covers and holds the male genitals in their natural places, providing better comfort, protection, support, and style than do conventional or alternative underwear garments. The brief is worn alone or with conventional briefs, boxers, athletic supporters, or swimwear. Certain beaches of the world, private swimming pools, and sun bathing areas will openly accept this garment as a new form of bathing suit for men.

The brief is designed for use to replace a standard brief, an athletic supporter, and swimwear, whether it be a sun bathing suit or a swim suit. Because of correct genital conformity, the brief provides uninterrupted comfort and support for any usage, for any daily activity; performing physical labor, desk work, strenuous athletic activity, foreplay, or even tossing and turning during a sleepless night in bed.

Thus the reader will see that the design of the brief is a real and practicable advancement in men's underwear and swimwear. The configured design of the brief meets the long-sought need for total comfort, support, and style. The brief's brevity is not for the purpose of scant sexual attire. The brevity of the brief, with its exact genital characteristics, is a substantially more complex design than the obvious brief pants attire of conventional underwear styles. Its brevity comes from designing an undergarment around the shape of the genitalia so that it fits and clothes the true features of the genitals, including the continual shifting of the scrotum and the flaccid and erect positions of the penis. For the purpose of superior support and comfort it is necessary to allow the most sensitive area of a man's body to be clothed by a garment which is designed to follow and hold the shapes of the genitals, rather than distorting their anatomical structure into the genital contortions that have been discussed in the conventional and alternative underwear garments above.

This design acts as a sheath, holding the male genitals in two form fitting, integrated pouches for the purpose of supporting the two prominent parts of the male genitalia, i.e., the penis and the scrotum. My underwear/swimwear is not held to the body by something so awkwardly unrelated to the genital region as the waist. Rather, the brief's opening holds to the body by wrapping around the perimeter of the proximal end of the genitals (the pubic region at the top, and perineum at the bottom). This new design covers, holds, and supports the genitals in their natural place. There can be no bunching, crowding, or sticking because the identical image construction of this garment maintains the genital separation as they are naturally found. Because of the integrated two-pouch system, genital separation is also maintained through all of the genital shifts; again, from flaccid to erect for the penis, and the contracting and expanding of the scrotum.

My underwear/swimwear protects the penis from desensitizing friction and unwanted rubbing, and protects the scrotum from cramping and squeezing. As it conforms to the body, the aesthetics of this design possess clean, simple lines that do not distort, interfere with, or add anything to the classic look of the male anatomy. Thus, the male anatomy is supported in a non-constrictive and non-intrusive way, allowing complete expression of its natural style.

The brief overcomes all of the difficulties described above. My underwear/swimwear looks different because it does not follow the primary flaw of conventional single-pouch styles, and is not impeded by their failure to provide all day long, uninterrupted comfort and support. The main purpose is comfort, the residual effects are great support, and stylish looks. Design following shape equals total comfort, support, and style.

Although the description above contains many specificities, these should not be construed as limiting the scope of the invention, but as merely providing illustrations of some of the presently preferred embodiments of this invention. Other embodiments and variations are possible.

For example, the brief can be assembled using more than two fabric pieces and accomplished in ways other than specifically described. The aim is to create a conforming genital cover. One construction can be a four-piece assembly. The forward portion of the penile pouch, the area that extends forward of the outer indentation, can be constructed of two identical fabric pieces. The scrotum pouch, rear penile pouch, collar, and entrance can be the main body of the brief and also be constructed of two identical separate pieces. Each identical pair is assembled around their peripheries, then the forward penile portion is aligned with the main body portion and stitched around the aligned circumference; in a similar way that a shirt sleeve is attached to the main body of a shirt.

Another four-piece assembly is to divide the brief at the indentations. The penile pouch, the collar, and the entrance opening become an upper two-piece assembly, and the scrotum pouch a lower two-piece assembly. Then the upper and the lower assemblies are aligned and stitched together at the indentation division.

In order to accommodate various scrotum sizes a fabric pleat can be constructed into the scrotum pouch that extends across the pouch between the two indentation points. The pleat can be opened or closed by using a strip of hook-and-loop fastener running lengthwise along the top and the bottom of the pleat. To close the pleat the wearer seals the fastener. To open the pleat, the fastener would remain open.

The retainer for the entrance opening closure can be achieved by leaving closure hem 38 open at the top and inserting different closure mechanisms, such as, a drawstring, belt, chain, frog closure, pull tabs connected to elastic, and hook-and-loop fastener.

For the fourth embodiment fly system, the stay used to hold the rear edge of the tip piece flat against the rear piece can be a snap, a button, a hook-and-loop fastener, a lingerie hook-and-loop, a zipper channel, or as used in the prototype, a narrow strip of elastic inserted into a hem of the rear edge of the tip piece to help hold its shape. The fly system can be alternately created in reverse, by having the rear piece lying on top of and overlapping the tip piece. This would place the fly opening near the front of the penile pocket facing forward, instead of towards the rear of the penile pocket facing rearward.

The fifth embodiment has a closure at the distal end of the penile pouch, this closure may be accomplished by using a zipper, snaps, buttons, a drawstring, hook-and-loop fasteners, lingerie hook-and-loop, hook-and-eye, frog closures, and any garment closing device.

The specific construction of the seventh embodiment may greatly vary to meet any desire or need, depending on the exact style of conventional underwear being modified with the brief. The key concept is the replacement of the crotch panels of conventional underwear and swimwear with the brief. The specific nature and design of conventional underwear/swimwear that may be used and modified to accommodate the brief varies from briefs, boxers, bike shorts, bikinis, athletic supporters, thongs, or any underwear/swimwear/sunwear designs can be adapted for the brief to replace their conventional crotch portions. Another method for utilizing the brief with conventional underwear and swimwear is to construct an aperture in the crotch portion of any conventional underwear or swimwear garment. First don the brief, next the conventional garment, and allow the brief to slide through the aperture to the outside of the conventional garment.

The conventional embodiment utilizes and takes advantage of the fully functional features of the brief (e.g., no bunching, compacting, squeezing, entanglements, adjustments, etc., of the male genitals through the unique construction of anatomic conformity). Additionally, any of the prior embodiments of the brief can be used in constructing preferred embodiment seven.

Alternately, for this conventional embodiment, the brief can be made to have a looser fitting entrance, and looser fitting penile and scrotum pouches. This looser fit will allow the brief to more easily adapt to various genital sizes for accommodating the wearer's genitalia, making it easier for the wearer to don the conventional embodiment. This will allow the consumer to more readily become accustomed to the new anatomic technology of the brief.

A complete array of fabrics, spectrum of colors and print designs may be used to make the brief. For the purpose of the aesthetic value of the brief, besides the attractiveness of its natural styling, specialty prints will be created to accentuate the lines, and the sportiness of the design. Also a trademark and a logo can be part of the brief. A trademark and a logo can be placed anywhere on the brief; on the penile pouch, the scrotum pouch, the invisible collar area, the elastic hem closure, and the exposed elastic closure. The trademark and logo can be placed on the brief in many ways, e.g., embroidered, embossed, silk screened, label attachment, applique, as part of a print design, as part of a color scheme, and tagging.

Thus the scope of the invention should be determined, and measured by the appended claims, and their legal equivalents, rather than by the examples given.

I claim:

1. A garment for a male individual, said male individual having a penis and a scrotum, said garment comprising:

(a) a penis pouch shaped to cover and enclose said penis, and (b) a scrotum pouch shaped to cover and enclose said scrotum, (c) said penis pouch being joined to said scrotum pouch so as to form a single constructed garment with a common entrance opening that provides a retaining closure around the base of the genitals, (d) said garment is constructed of cloth, whereby said garment clothes said genitalia in a covering that conforms to said penis, said scrotum and said genital base, and holds and supports said genitalia in a comfortable, supportive and stylish way.

2. A garment for a male individual, said male individual having a penis and a scrotum, said garment comprising:

a penis pouch shaped to cover and enclose said penis;

a scrotum pouch shaped to cover and enclose said scrotum;

said penis pouch being joined to said scrotum pouch so as to form a single constructed garment with a common opening; and a pair of male briefs, said common opening of said garment being attached to an aperture on a front portion of said male briefs;

whereby said garment clothes said genitalia in a covering that conforms to said penis and said scrotum and holds and supports said genitalia in a comfortable and stylish way.

3. A garment for a male individual, said male individual having a penis and a scrotum, said garment comprising:

a penis pouch shaped to cover and enclose said penis; and a scrotum pouch shaped to cover and enclose said scrotum;

said penis pouch being joined to said scrotum pouch so as to form a single constructed garment with a common opening;

said garment being formed of two pieces of all-way stretch material which have been joined together;

whereby said garment clothes said genitalia in a covering that conforms to said penis and said scrotum and holds and supports said genitalia in a comfortable and stylish way.

4. A garment for a male individual, said male individual having a penis and a scrotum, said garment comprising:

a penis pouch shaped to cover and enclose said penis; and a scrotum pouch shaped to cover and enclose said scrotum;

said penis pouch being joined to said scrotum pouch so as to form a single constructed garment with a common opening;

said penis pouch containing a fly for allowing said individual to urinate while wearing said garment;

whereby said garment clothes said genitalia in a covering that conforms to said penis and said scrotum and holds and supports said genitalia in a comfortable and stylish way.

5. A garment for a male individual, said male individual having a penis and a scrotum, said garment comprising:

a penis pouch shaped to cover and enclose said penis;

a scrotum pouch shaped to cover and enclose said scrotum;

said penis pouch being joined to said scrotum pouch so as to form a single constructed garment with a common opening; and an undemarcated collar portion connected to said common opening;

whereby said garment clothes said genitalia in a covering that conforms to said penis and said scrotum and holds and supports said genitalia in a comfortable and stylish way.

6. A garment for a male individual, said male individual having a penis and a scrotum, said garment comprising:

a penis pouch shaped to cover and enclose said penis; and a scrotum pouch shaped to cover and enclose said scrotum;

said penis pouch being joined to said scrotum pouch so as to form a single constructed garment with a common opening for both pouches;

said penis pouch including a distal end opening for allowing said individual to urinate while wearing said garment;

whereby said garment clothes said genitalia in a covering that conforms to said penis and said scrotum and holds and supports said genitalia in a comfortable and stylish way.

7. A garment for a male individual, said male individual having a penis and a scrotum, said garment comprising:

a penis pouch shaped to cover and enclose said penis;

a scrotum pouch shaped to cover and enclose said scrotum;

said penis pouch being joined to said scrotum pouch so as to form a single constructed garment with a common opening for both pouches; and an indentation mechanism which creates an indentation between said penis pouch and said scrotum pouch, and allowing said penis to be removed from said penis pouch without removing said scrotum pouch, thereby allowing said individual to urinate while without completely removing said garment;

whereby said garment clothes said genitalia in a covering that conforms to said penis and said scrotum and holds and supports said genitalia in a comfortable and stylish way.

8. An underwear garment for clothing a human male genitalia, said male has a penis and a scrotum, said garment comprising:

a penis pouch shaped to conform to and enclose a penis of a predetermined size, said penis pouch comprising a cylindrical member having a closed distal end and an open proximal end;

a scrotum pouch shaped to conform to and enclose a scrotum of a predetermined size, said scrotum pouch comprising a container having a closed distal end and an open proximal end; and means connecting said open proximal end of said penis pouch and said open proximal end of said scrotum pouch to form a common proximal opening for both of said pouches;

said underwear garment being formed of two pieces of eight-way stretch fabric that have been joined together;

whereby said garment clothes said genitalia in a covering that conforms to said penis and said scrotum and holds and supports said genitalia in a comfortable and stylish way.

9. An underwear garment for clothing a human male genitalia, said male has a penis and a scrotum, said garment comprising: a penis pouch shaped to conform to and enclose a penis of a predetermined size, said penis pouch comprising a cylindrical member having a closed distal end and an open proximal end;

a scrotum pouch shaped to conform to and enclose a scrotum of a predetermined size, said scrotum pouch comprising a container having a closed distal end and an open proximal end; and means connecting said open proximal end of said penis pouch and said open proximal end of said scrotum pouch to form a common proximal opening for both of said pouches;

a conventional male underwear, said common proximal opening of said underwear garment being attached to an aperture on a front crotch portion of said conventional male underwear;

whereby said garment clothes said genitalia in a covering that conforms to said penis and said scrotum and holds and supports said genitalia in a comfortable and stylish way.

10. An under wear garment for clothing a human male genitalia, said male has a penis and a scrotum, said garment comprising:

a penis pouch shaped to conform to and enclose a penis of a predetermined size, said penis pouch comprising a cylindrical member having a closed distal end and an open proximal end;

a scrotum pouch shaped to conform to and enclose a scrotum of a predetermined size, said scrotum pouch comprising a container having a closed distal end and an open proximal end; and means connecting said open proximal end of said penis pouch and said open proximal end of said scrotum pouch to form a common proximal opening for both of said pouches;

said penis pouch containing a fly opening for allowing said individual to expose said penis to urinate while wearing said underwear garment;

whereby said garment clothes said genitalia in a covering that conforms to said penis and said scrotum and holds and supports said genitalia in a comfortable and stylish way.

11. An underwear/swimwear garment for covering the male genitalia on the front of a human male, said underwear/swimwear garment comprising:

a single container with two pouch sections and a common entrance opening;

a penile pouch of said two pouch sections configured to house and accommodate all changing sizes of said penis, said penis pouch comprising a tubular chamber with ai rounded and closed distal end, and an open proximal end;

a scrotum pouch of said two pouch sections covering and supporting all changing sizes of said scrotum, said scrotum pouch comprising an irregular rounded perimeter chamber, a closed posterior end, and an open superior end; and means connecting said open proximal end of said penis pouch and said open superior end of said scrotum pouch to form a common integrating band and a proximal entrance opening;

said underwear/swimwear garment is constructed of two pieces of two-way stretch material which have been attached together;

whereby said underwear/swimwear garment is anatomically crafted to clothe said genitalia in a casing that conforms to said penis and said scrotum and holds and supports said genitalia in a comfortable and stylish way.

12. An underwear/swimwear garment for covering the male genitalia on the front of a human male, said underwear/swimwear garment comprising:

a single container with two pouch sections and a common entrance opening;

a penile pouch of said section configured to house and accommodate all changing sizes of said penis, said penis pouch comprising a tubular chamber having a rounded and closed distal end and an opposite open proximal end;

a scrotum pouch of said section engineered to cover and support all changing sizes of said scrotum, said scrotum pouch comprising an irregular rounded perimeter chamber and a closed posterior end and an opposite and open superior end;

means connecting said open proximal end of said penis pouch and said open superior end of said scrotum pouch to form a common integrating band and a proximal entrance opening; and a male underwear/swimwear garment, said underwear/swimwear garment providing a front crotch panel for said male underwear/swimwear garment;

whereby said underwear/swimwear garment is anatomically crafted to clothe said genitalia in a casing that conforms to said penis and said scrotum and holds and supports said genitalia in a comfortable and stylish way.

13. An underwear/swimwear garment for covering the male genitalia on the front of a human male, said underwear/swimwear garment comprising:

a single container with two pouch sections and a common entrance opening;

a penile pouch of said section configured to house and accommodate all changing sizes of said penis, said penis pouch comprising a tubular chamber having a rounded and closed distal end and an opposite open proximal end;

a scrotum pouch of said section engineered to cover and support all changing sizes of said scrotum, said scrotum pouch comprising an irregular rounded perimeter chamber and a closed posterior end and an opposite and open superior end; and means connecting said open proximal end of said penis pouch and said open superior end of said scrotum pouch to form a common integrating band and a proximal entrance opening;

said penis pouch including a fly opening for allowing said individual to expose said penis to urinate while wearing said underwear garment;

whereby said underwear/swimwear garment is anatomically crafted to clothe said genitalia in a casing that conforms to said penis and said scrotum and holds and supports said genitalia in a comfortable and stylish way.

14. An underwear/swimwear garment for covering the male genitalia on the front of a human male, said underwear/swimwear garment comprising:

a single container with two pouch sections and a common entrance opening;

a penile pouch of said section configured to house and accommodate all changing sizes of said penis, said penis pouch comprising a tubular chamber having a rounded and closed distal end and an opposite open proximal end;

a scrotum pouch of said section engineered to cover and support all changing sizes of said scrotum, said scrotum pouch comprising an irregular rounded perimeter chamber and a closed posterior end and an opposite and open superior end; and means connecting said open proximal end of said penis pouch and said open superior end of said scrotum pouch to form a common integrating band and a proximal entrance opening;

said underwear/swimwear garment is formed of two pieces of non-stretch material which have been connected together and said proximal entrance opening extends into a portion of the top seam of said penis pouch to allow said underwear/swimwear garment to be easily donned;

whereby said underwear/swimwear garment is anatomically crafted to clothe said genitalia in a casing that conforms to said penis and said scrotum and holds and supports said genitalia in a comfortable and stylish way.

* * * * *